US005262259A

United States Patent [19]

Chou et al.

[11] Patent Number: 5,262,259

[45] Date of Patent: Nov. 16, 1993

[54] TONER DEVELOPED ELECTROSTATIC IMAGING PROCESS FOR OUTDOOR SIGNS

[75] Inventors: Hsin-hsin Chou, Woodbury; John F. Eisele, Lakeland; Gaye K. Lehman, St. Paul; Wu-Shyong Li, Woodbury; Valdis Mikelsons, Mendota Heights; Michael J. Petrich, Lakeland; Prabhakara S. Rao, Vadnais Heights; Thomas J. Staiger, Hastings; Paul J. Wang, Woodbury, all of Minn.; Gregory L. Zwaldo, Ellsworth, Wis.; Michael G. Baier, Maplewood; Richard H. Olson, St. Paul, both of Minn.

[73] Assignee: Minnesota Mining and Manufacturing Company, St. Paul, Minn.

[21] Appl. No.: 510,597

[22] Filed: Apr. 18, 1990

Related U.S. Application Data

[63] Continuation-in-part of Ser. No. 460,395, Jan. 3, 1990, abandoned.

[51] Int. Cl.[5] ..... G03G 13/14; G03G 21/00

[52] U.S. Cl. ..... 430/47; 430/42; 430/126

[58] Field of Search ..... 430/42, 47, 48, 52, 430/102, 126, 45, 97; 346/157; 428/343, 352, 447

[56] References Cited

U.S. PATENT DOCUMENTS

| | | | |
|---|---|---|---|
| 2,297,691 | 10/1942 | Carlson | 95/5 |
| 2,752,833 | 7/1956 | Jacob | 95/1.7 |
| 2,899,335 | 8/1959 | Straughan | 117/37 |
| 2,907,674 | 10/1959 | Metcalfe et al. | 117/37 |
| 2,986,466 | 5/1961 | Kaprelian | 96/1 |
| 3,075,859 | 1/1963 | Ralph et al. | 117/201 |
| 3,185,777 | 5/1965 | Rheinfrank | 179/100.2 |
| 3,337,340 | 8/1967 | Matkan | 96/1 |
| 3,476,659 | 11/1969 | Sato et al. | 204/18 |

(List continued on next page.)

FOREIGN PATENT DOCUMENTS

0194776A3 9/1986 European Pat. Off. .
0444870A2 9/1991 European Pat. Off. .

OTHER PUBLICATIONS

Patent Abstracts of Japan, vol. 11, No. 164 (P-580)(2611) May 27, 1987 and JP-A-61 296 354 (Daicel) Dec. 27, 1986.

L. E. Nielsen, *Mechanical Properties of Polymers and Composites*, 2d Ed., Chapter 5, pp. 69-86, 1980.

"Surface Energy Analysis of Treated Graphite Fibers," D. H. Kaeble and P. J. Dynes, *J. Adhesion*, 1974, vol. 6, pp. 239-258.

"A Theory for the Estimation of Surface and Interfacial Energies," L. A. Girifalco and R. J. Good, *J.A.C.S.*, 1957, vol. 61, pp. 904-909.

"A New Approach to Quantify Acid-base Interactions in Adhesion," W. V. Chang and F. Chen, J. Phys. Chem. vol. 62, 1988, pp. 607-613.

"Determination of Surface Free Energy Components of Polymers from Contact Angle Data Using Nonlinear Programming Methods," *Colloids and Surfaces*, 33, (1988) pp. 85-97.

*Primary Examiner*—Marion E. McCamish
*Assistant Examiner*—Rosemary Ashton
*Attorney, Agent, or Firm*—Gary L. Griswold; Walter N. Kirn; Mark A. Litman

[57] ABSTRACT

An electrographic imaging process is described in which electrostatic images are toned in sequence to form a multicolor intermediate image on a temporary dielectric receptor. The intermediate image is then transferred to a permanent receptor. Certain relative properties of the toner and the intermediate image, such as surface energy, $T_g$, work of adhesion, and complex dynamic viscosity, have been found to be important to the production of good final images.

36 Claims, 1 Drawing Sheet

U.S. PATENT DOCUMENTS

| | | | |
|---|---|---|---|
| 3,554,836 | 1/1971 | Steindorf | 156/240 |
| 3,594,161 | 7/1971 | Kaufman | 96/1 |
| 3,607,258 | 9/1971 | Hoesl et al. . | |
| 3,652,319 | 3/1972 | Amidon et al. | 117/37 |
| 3,690,756 | 9/1972 | Smith | 355/4 |
| 3,716,360 | 2/1973 | Fukushima et al. | 96/1.4 |
| 3,839,032 | 10/1974 | Smith et al. | 96/1.4 |
| 3,847,642 | 11/1974 | Rhodes | 117/17.5 |
| 3,850,829 | 11/1974 | Smith et al. | 252/62.1 |
| 3,851,964 | 12/1974 | Smith et al. | 355/10 |
| 3,920,880 | 11/1975 | Akiyama et al. | 428/500 |
| 3,935,154 | 1/1976 | Cawley | 260/33.8 |
| 3,939,085 | 2/1976 | Smith et al. | 252/62 |
| 3,958,990 | 5/1976 | Parent | 96/1.4 |
| 3,993,825 | 11/1976 | Buchan et al. | 428/216 |
| 4,007,041 | 2/1977 | Chow | 96/1 |
| 4,007,489 | 2/1977 | Helmberger et al. | 358/78 |
| 4,014,696 | 3/1977 | Parent | 96/1.4 |
| 4,033,688 | 7/1977 | Orthmann | 355/4 |
| 4,066,802 | 1/1978 | Clemans | 427/24 |
| 4,078,927 | 3/1978 | Amidon et al. | 96/1 |
| 4,134,763 | 1/1979 | Fujimura et al. | 96/1.5 |
| 4,155,862 | 5/1979 | Mohn et al. | 252/62.1 |
| 4,201,701 | 5/1980 | Coney | 260/22 |
| 4,208,467 | 6/1980 | Coney | 428/480 |
| 4,216,283 | 8/1980 | Cooper et al. | 430/126 |
| 4,234,250 | 11/1980 | Mailloux et al. | 355/4 |
| 4,236,809 | 12/1980 | Kermisch | 355/4 |
| 4,259,422 | 3/1981 | Davidson et al. | 430/17 |
| 4,275,136 | 6/1981 | Murasawa et al. | 430/117 |
| 4,336,994 | 6/1982 | Banton | 355/4 |
| 4,337,303 | 6/1982 | Sahyun et al. | 430/11 |
| 4,370,047 | 1/1983 | Damouth et al. | 355/3 |
| 4,403,848 | 9/1983 | Snelling | 355/4 |
| 4,467,334 | 8/1984 | Anzai | 346/160 |
| 4,480,022 | 10/1984 | Alexandrovich et al. | 430/119 |
| 4,569,584 | 2/1986 | St. John et al. | 355/14 R |
| 4,599,293 | 7/1986 | Eckell et al. | 430/126 |
| 4,600,673 | 7/1986 | Hendrickson et al. | 430/66 |
| 4,656,087 | 4/1987 | Lubianez et al. | 428/323 |
| 4,728,983 | 3/1988 | Zwadlo et al. | 355/4 |
| 4,731,542 | 3/1988 | Doggett | 250/548 |
| 4,756,985 | 7/1988 | Haneda et al. | 430/42 |
| 4,772,526 | 9/1988 | Kan et al. . | |
| 4,808,832 | 2/1989 | Doggett | 250/548 |
| 4,869,982 | 9/1989 | Murphy | 430/48 |
| 4,883,731 | 11/1989 | Tam et al. | 430/41 |
| 4,946,753 | 8/1990 | Elmasry et al. | 430/45 |
| 5,045,391 | 9/1991 | Brandt et al. | 428/336 |
| 5,106,710 | 4/1992 | Wang et al. | 430/42 |

TONER DEVELOPED ELECTROSTATIC IMAGING PROCESS FOR OUTDOOR SIGNS

Application is a continuation in part of U.S. Ser. No. 07/460,395 filed Jan. 3, 1990, abandoned.

BACKGROUND OF THE INVENTION

1. Field of Invention

The invention relates to processes of making large size full color images by electrographic means. In particular it relates to a multicolor electrographic process using a one-pass printer followed by transfer of the image to a receptor surface.

2. Background of the Art

A general discussion of color electrophotography is presented in "Electrophotography", by R. M. Schaffert, Focal Press, London & New York, 1975, pages 178–190.

Full color reproductions by electrophotography were disclosed by C. F. Carlson in his early patents (U.S. Pat. No. 2,297,691) but no detailed mechanisms were described. Another early patent (U.S. Pat. No. 2,752,833) by C. W. Jacob discloses a method based on a single transparent drum coated with a photoconductor around which a web of receptor paper is fed. Electrostatic images are produced on the drum and by induction on the receptor paper, by three colored line scan exposures from inside the drum using a CRT. Charging stations precede and toner stations follow each of these scan positions with suitable time delays between the scans. The final tricolor image is assembled directly on the imaging paper. In U.S. Pat. No. 4,033,688 (Agfa-Gevaert) a single photoconductive drum is exposed to three different color beams reflected from a color original. The incident reflections occur at points around its circumference, each point being provided with the requisite charging and toning stations. Mechanical time delays provide registration of the three color images which are then transferred to a receptor sheet. Other similar systems are disclosed in U.S. Pat. Nos. 4,403,848 and 4,467,334. All these systems use optical exposure as the method of addressing the imaging surface which avoids mechanical contact with the surface. The use of a sequence of exposure/toning stations immediately following one another as opposed to multiple drum rotations as found in other methods (e.g., U.S. Pat. No. 4,728,983) gives higher production rates for the color prints.

Many patents (e.g., U.S. Pat. Nos. 2,986,466; 3,690,756; 4,370,047) use three or four different photoconductor drums or belts for the different colors and assemble the toned images in register on a receptor sheet.

Exposure by conventional optical scanning is disclosed in many patents e.g., U.S. Pat. Nos. 3,690,756; 4,033,688; 4,234,250. CRT scanning is disclosed in U.S. Pat. No. 2,752,833, and laser scanning on its own or in combination with conventional exposures occurs in patents such as U.S. Pat. Nos. 4,234,250; 4,236,809; 4,336,994; 4,348,100; 4,370,047; 4,403,848; and 4,467,334.

The use of electrographic processes, as opposed to the electrophotographic processes described above, is well represented in the art. In these processes the electrostatic latent image is produced directly by "spraying" charge onto an accepting dielectric surface in an imagewise manner. Styli are often used to create these charge patterns and are arranged in linear arrays across the width of the moving dielectric surface. These processes and the required apparatus are disclosed for example in U.S. Pat. Nos. 4,007,489, 4,569,584, 4,731,542 and 4,808,832. In U.S. Pat. No. 4,569,584 only one stylus array is used and the accepting surface web is traversed to and fro to make the successive images, the toning stations being disposed on either side of the single charging station. In the other three references noted above, the printer comprises three or more printing stations in sequence, each containing both charging arrays and toning stations. In all of these, the multicolor toner image is assembled on the accepting surface and fixed there for display on that surface as a support. None of these references discloses or discusses transferring the assembled image to a receptor surface.

The toners disclosed by C. F. Carlson (U.S. Pat. No. 2,297,691) were dry powders. Staughan (U.S. Pat. No. 2,899,335) and Metcalfe & Wright (U.S. Pat. No. 2,907,674) pointed out that dry toners had many limitations as far as image quality is concerned, especially when used for superimposed color images. They recommended the use of liquid toners for this purpose. These toners comprised a carrier liquid which was of high resistivity e.g., $10^9$ ohm.cm or more, and had both colorant particles dispersed in the liquid and preferably an additive intended to enhance the charge carried by the colorant particles. Matkan (U.S. Pat. No. 3,337,340) disclosed that a toner deposited first may be sufficiently conductive to interfere with a succeeding charging step; he claimed the use of insulative resins (resistivity greater than $10^{10}$ ohm.cm) of low dielectric constant (less than 3.5) to cover each colorant particle.

In U.S. Pat. No. 4,155,862 the charge per unit mass of the toner was related to difficulties experienced in the art in superposing several layers of different colored toners. This latter problem was approached in a different way in U.S. Pat. No. 4,275,136 where adhesion of one toner layer to another was enhanced by an aluminum or zinc hydroxide additive on the surface of the toner particles.

Liquid toners which provide developed images which rapidly self-fix to a smooth surface at room temperature after removal of the carrier liquid are disclosed in U.S. Pat. Nos. 4,480,022 and 4,507,377. These toner images are said to have higher adhesion to the substrate and to be less liable to crack. No disclosure is made of their use in multicolor image assemblies.

A number of methods have been disclosed in the patent literature intended to effect liquid toner image transfer with high quality.

The use of silicones and polymers containing silicones as mould release layers and leveling compounds as additives to layers to give release properties is well known.

In the electrophotographic field, photoconductive layers topcoated with silicone layers are disclosed in U.S. Pat. Nos. 3,185,777; 3,476,659; 3,607,258; 3,652,319; 3,716,360; 3,839,032; 3,847,642; 3,851,964; 3,939,085; 4,134,763; 4,216,283; and Jap. App. 81699/65.

In U.S. Pat. No. 3,652,319, easily liquidified solids such as silicone waxes with melting points between 20° C. and 95° C. are applied continually to the photoconductor surface while in use under repetitive cycling conditions. The temperature is slightly elevated at the point of application of the wax to melt and allow spreading of it. Later in the cycle, the wax solidifies into a layer before exposure. The wax layer is renewed every cycle by further applications. The thickness of the wax layer appears to be in the range of 50 nm to 1500 nm with an optimum range of about 200 nm to 800 nm.

U.S. Pat. No. 3,839,032 and its two divisional applications U.S. Pat. Nos. 3,851,964 and 3,939,085 are concerned with liquid toner development and toner image transfer from photoconductors to receptors in which the toner image is temporarily tacky and exhibits more adhesion for the receptor surface than for the photoconductor surface. Novel liquid toner formulations are disclosed having these properties. Low adhesion to the photoconductor surface may be obtained by methods including coating a layer of silicone on the surface. The examples disclose formulations for these layers but give no idea of thickness. Two dependent claims talk of ". . . decreasing the affinity of the photoconductive layer for the tacky image . . . " Introductory discussion indicates the invention (Col. 2 lines 1-16) solves problems of incomplete transfer of liquid toner images and loss of definition experienced in the art.

U.S. Pat. No. 3,850,829 is a later patent and refers to the results in U.S. Pat. No. 3,839,032 as still exhibiting loss of definition. This patent discloses that inclusion of a silicone in the tacky liquid toner gives better results than the silicone layer on the photoconductor.

In U.S. Pat. No. 3,847,642 a transfer film of between 2 μm and 25 μm (preferably about 5 μm) is applied to the photoconductor surface during the imaging cycle. The material must have a low, sharp melting point so that after toning, application of heat melts it and on image transfer part of the layer transfers with the toner and solidifies again. Silicone waxes of low melting point are amongst materials suggested.

In U.S. Pat. No. 4,216,283 one embodiment (Col. 8 lines 63-68, and Col. 9 lines 1-30) describes a thin release layer, which can be of the type of the Syl-OFF TM materials, applied to a zinc oxide photoconductor layer (or others which appear to include organic photoconductors) to ensure transfer of the liquid toned image. No indication is given of the thickness of the Syl-OFF TM layer or of its relationship with the effectiveness of toner release. The main embodiments and claims concern the use of an abherent layer (e.g. Syl-OFF TM) coated intermediate transfer sheets for use with Xerographic system.

In addition to patents dealing with silicone release layers, there are also patents describing the use of silicones in other ways. U.S. Pat. Nos. 3,476,659; 3,594,161; 3,851,964; 3,935,154; and 4,078,927 all disclose the use of silicones as additives to the photoconductor layer itself to give release properties towards both toners and inks (electrographic printing plates). Patents also deal with transfer intermediate sheets, belts, rollers and blankets for transfer of the toned image from the photoconductor to the receptor, in which silicone treatment of the intermediate is proposed. Example patents are U.S. Pat. Nos. 3,554,836; 3,993,825; 4,007,041; 4,066,802; and 4,259,422.

U.S. Pat. No. 4,656,087 discloses dielectric layers for electrographic imaging wherein polysiloxane materials are added to the dielectric resin(s) at the same time as the particulate matter. Japanese unexamined patent application JP 57-171339 published on Oct. 21, 1982 discloses a dielectric layer comprising an organic silicon polymer containing siloxane bonding as the main chain, and another resin in the ratio range 1:4 to 4:1 by weight.

U.S. Pat. No. 4,772,526 discloses photoconductive layer assemblies for electrophotographic systems in which the top layer, either the charge transport layer or the change generation layer, comprises a block copolymer of a fluorinated polyether and a polyester or a polycarbonate. The surface exhibits good toner release properties because of the presence of the fluorinated polyether.

Receptor sheets for the transfer of deposited liquid toner images are well known in the art. For example U.S. Pat. No. 4,337,303 discloses receptor layers which under elevated temperature encapsulate the toner from an imaging surface pressed against the receptor. The physical properties required of the receptor surface are disclosed.

SUMMARY OF THE INVENTION

In the practice of this invention the term "electrography" means a process of producing images by addressing an imaging surface, normally a dielectric material, with static electric charges (e.g., as from a stylus) to form a latent image which is then developed with a suitable toner. The term is distinguished from "electrophotography" in which an electrostatic charge latent image is created by addressing a photoconductive surface with light. The term "electrostatic printing" and the like is commonly used in the literature and appears to encompass both electrography and electrophotography.

This invention provides a process of making stable, high quality, full color images in large size particularly for exhibiting outdoors.

This invention provides a process by which a full color large size image can be produced in one pass or multiple passes through an electrographic printer and subsequently transferred without loss in quality to a final receptor sheet.

Another aspect of the invention is to provide an economical method of producing a small number of large size copies of multicolor images sufficiently durable for outdoor display.

This invention further provides means to choose a combination of toners, imaging surface, and final receptor surface for the electrographic process practiced in a one-pass printer which result in consistent high quality imaging without loss either during passage through the printer or during transfer.

The invention provides a process of multicolor liquid toner electrography on a dielectric surfaced imaging sheet using a one-pass electrostatic printer comprising a sequence of printing stations, one for each color to be printed, in which the last step of the process is a thermal transfer of the image from the imaging surface to a final receptor surface. The use of a one-pass printer gives the user the advantages of fast production with less complicated handling than found with multipass printers. The final images made by this process are particularly designed for outdoor display. One example use is the provision of easily and economically replaced full color signs on truck sides which are presently provided by silk screen printing or by direct art work.

Electrostatic printers suitable for the process of this invention (such as those made by Synergy Computer Graphics) may comprise a number of printer stations of the following nature which contact the imaging surface in sequence, a) a stylus or electrostatic imaging bar by means of which an electrostatic image is produced on the dielectric surfaced imaging sheet as it moves past the station, b) a liquid toner developing device, normally involving an applicator roller rotating at a different speed from the progress of the dielectric surface or even contrarotating relative to the surface, c) a vacuum squeegee to remove excess toner and then a drying system to remove the solvent present in the imagewise deposited toner.

The mechanical units in a), b), and c) in particular, physically contact the imaging surface and are abusive to the surface compared with non-contact processes such as those using light addressed electrophotographic materials. These printers have previously been used in a mode whereby the toner image is permanently fixed to the dielectric imaging sheet surface. They have been shown in the art to be particularly applicable to the making of large size prints; imaging surface webs of three or four feet in width and of substantially unlimited length have been produced. This contrasts with the substantially limited size of prints which have been made by the various electrophotographic methods.

When large size prints are required, especially for exhibition outdoors, the properties of the dielectric imaging sheet are frequently not suitable for the final image support. The typical paper substrates lack the water and UV resistance required for outdoor signing, and more resistant substrates such as Plexiglass, 3M Panaflex TM, 3M Scotchcal TM, and polyester films cannot be imaged directly because of either their mechanical or electrical properties.

Transferring the image from the imaging sheet to a separate receptor sheet allows the latter to be chosen to have the required properties for the final print. In this case, however, during the thermal/pressure transfer process, the imaging sheet must have lower adhesion for each of the several toners than the receptor sheet for the toners. This is easily obtainable except that there is a conflicting requirement that the image toners deposited on the imaging sheet must be firmly enough adherred to the receptor and to each other to ensure they are not removed or damaged during the passage through the one-pass printer. In practice the combination of properties has proved difficult to obtain to satisfy these requirements. Not only must the adhesion created during the printing sequence for each toner to the imaging surface be low enough to release at subsequent transfer, but adhesion of a toner to each of the other toners must be sufficiently high to prevent separation, and also the cohesion and strength of the toner layers created during the printing process must be high enough to prevent damage.

In our invention we provide combinations of a dielectric imaging layer, at least two (commonly four) toners, and a receptor layer, so that the required properties during the process are obtained, and we provide means to select and obtain suitable combinations of materials. We have found that it is important to use measurements which provide that the properties are indeed those to be encountered during the process. Suitable means of measurement are described.

DETAILED DESCRIPTION OF THE DRAWINGS

Figure 1:
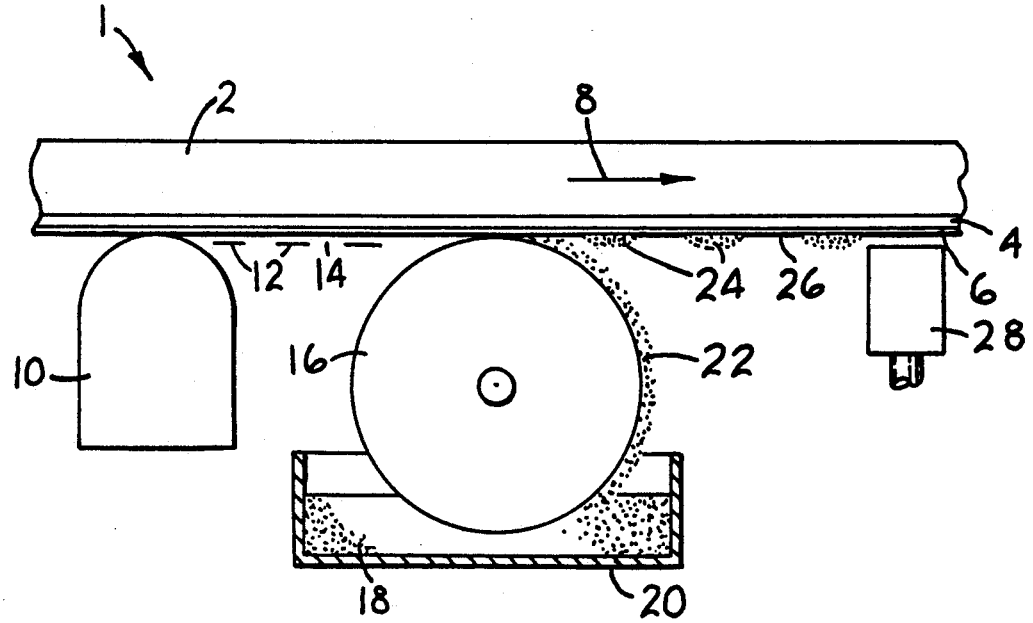
FIG. 1 shows one of the print stations useful in the present invention in diagrammatic detail.

FIG. 1 is a diagrammatic representation of one printing station which is of a type useful in the practice of the present invention. The intermediate photoconductive receptor 1 comprises a paper substrate 2 having first a dielectric layer 4 and then a release coating 6 on at least one surface. That surface of the intermediate receptor 1 passes through the station in a direction 8 so that the coated surface of the paper first passes a stylus writing head 10 which imagewise deposits a charge 12 leaving spaces on the surface which are uncharged 14. After passing by the writing head 10, the intermediate receptor 1 then passes a toning station comprising a toner applicator 16 which contacts a liquid toner bath 18 in a container 20. The liquid toner 22 is carried on the toner applicator 16 so that it is imagewise deposited on the intermediate receptor 1 providing toned areas 24 and untoned areas 26. The toned areas of the intermediate receptor 1 then pass under a vacuum squeegee 28 where excess toner is removed.

Figure 2:
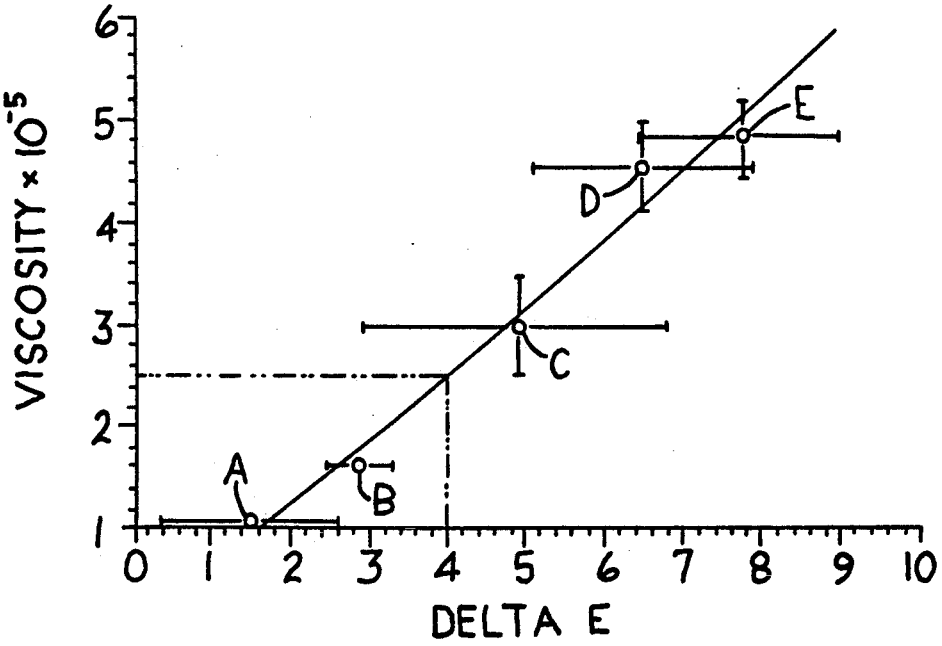
FIG. 2 is a graphical representation of the relationship between complex dynamic viscosity of the surface coating on a receptor sheet, and the CIELAB color difference value, $\Delta E$, for the toner remaining on an imaging sheet after transfer of the image to a the receptor sheet.

FIG. 2 is a graph showing the viscosity ($\times 10^{-5}$) in poise at 110° C. for five different materials as a function of $\Delta E$. The five materials are Elvacite TM 2044 (A), a 1:1 blend of clear and white ($TiO_2$ filled) blends of 4:1 vinyl chloride and acrylic resin (B), a white 4:1 blend of PVC and acrylic resin pigmented with $TiO_2$ (C), Elvacite TM 2010 (D), and clear cast polyvinyl chloride resin (E).

A typical electrographic printer station for carrying out the process of this invention is shown in diagrammatic form in FIG. 1. At each of these printer stations a separate image is deposited, commonly in one of the four different colors, black, cyan, magenta, and yellow. One of the printer stations is illustrated in FIG. 1, where the web 1 moves over and in contact with stylus charging bar 10, then passes on to liquid development roller 16, then passes in front of a vacuum squeegee 28, and finally is dried by an air current from vacuum drier or squeegee 28 (or blowers, now shown). To obtain complete development of the electrostatic latent image by the toner in as short a time as possible, the development roller 16 rotates at a speed greater than the web speed and is generally knurled to facilitate supply of toner to the surface with the dielectric coating 4. Toner properties must be such that their adhesion to the imaging surface and to any underlying toner must be sufficient to ensure that image toner is not removed again during its own or subsequent development. This develop,ent with a knurled roller in contact with the image contrasts with applied field induced electrophoresis development which is normally used in electrophotographic systems in which no mechanical member contacts the image.

Such printers are known in the art and may be obtained for example from Synergy Computer Graphics. The final image is displayed on the dielectric surfaced imaging material.

In our invention, for the reasons given above, we conclude the process by transferring the complete toner image from the dielectric surface to a receptor sheet. The imaging surface of the web carrying the assembled toner image is pressed against the receptor surface and heat is applied for a short time. This may be accomplished in many ways known in the art such as passing the sheets together through heated nip rollers, or placing them on a heated platten in a vacuum drawdown frame. The latter is the preferred method in this invention.

If the final image on the receptor sheet is to be of high quality and color fidelity the transfer must be complete and without distortion of the various color images. Under the conditions of the transfer process the toner image must therefore be released easily from the imaging surface and adhere to the receptor surface.

DETAILED DESCRIPTION OF THE INVENTION

In the art described above, it is seen that release layers used in toner transfer steps are common in electrophotographic systems. In the present invention, however, it is surprising that a release layer may be used without removal or partial removal of the deposited image toner under the stress of continued development with the knurled rollers. In practice we have found that severe image damage can result in some cases and objectional damage in many cases, and that this is dependent on the particular combination of toners, release layer, and receptor surface defined in the present invention. We have also found that the combination of toners presently used on printers such as the Synergy machine are unsuitable in our invention.

Our invention disclosure herein teaches how the correct choice of release surface, toners, and receptor surface may be made so that no image damage is experienced and yet full transfer is achieved.

We have found that surface energy values may be measured for the components used for the layers and that the required abhesive/adhesive properties can be specified in terms of these values. Thus:

a) the dielectric imaging surface must have a surface energy between 14 ergs/cm$^2$ and 20 ergs/cm$^2$ of which the polar component should not be more than 5%, b) the work of adhesion between any two overlapping toners deposited on the imaging surface must be greater than the work of adhesion between the imaging surface and any toner deposited on it; this is not relevant for the last developed toner in the process because that toner never has another deposited over it, c) no deposited toner may have a surface energy greater than 50 ergs/cm$^2$, d) the receptor surface must have a surface energy greater than that of the imaging surface.

It is preferred that the differences in b) and d) should be at least 5 ergs/cm$^2$ and more preferably at least 10 ergs/cm$^2$. Polar components in the surface energy values contribute heavily to the adhesion levels; the limit on polar content in the imaging surface in a), which is required to be a releasing surface, originates from this characteristic.

We have also found that even when the surface energy requirements are met, image damage is experienced if the deposited toners during the continuing process are too soft or not mechanically strong. This requirement is found to be efficiently defined by a scratch test defined hereafter. We have found that toner scratch strengths are valid criteria only when they relate to the conditions in the process itself. They must be carried out on samples of toner immediately after deposition, preferably no more than 8 minutes and more preferably no more than 2 minutes after the beginning of drying following deposition. Toner samples left for several hours after deposition have been found to give misleading values. For good performance in the invention toner scratch strengths indicated by compression or cracking of the surface in this test must be at least 40 g when measured not more than 8 minutes after the beginning of drying.

Similarly, good transfer is not assured by meeting only the surface energy requirements of the receptor surface. In addition, the $T_g$ of the surface should be in the range of 10° C. to a value about 5° C. below the temperature used in the transfer process (at an elevated temperature, i.e., above 30° C., normally about 50° C. to 150° C., preferably around 90° C. to 130° C., such as 110° C.) and the complex dynamic viscosity of the surface material should be below about $2\times10^5$ poise at the temperature of transfer. These added requirements promote adhesion and conformation with the imaging surface at the elevated temperature of transfer.

We will now discuss each of the component materials in the process in more detail.

Imaging Sheets

Imaging sheets comprise a flexible substrate on one surface of which is a dielectric layer. The substrate must of itself be electroconductive or it must carry a conductive layer on the surface underneath the dielectric layer.

Substrates may be chosen from a wide variety of materials including paper, plastics, etc. If a separate electroconductive layer is required, this may be of thin metal such as aluminum, or of tin oxide or other materials well known in the art to be stable at room temperatures and at the elevated temperatures of the transfer process.

Dielectric layers on a substrate for use in electrostatic printing are well known in the art—see for example Neblette's Handbook of Photography and Reprography, by C. B. Neblette, edited by John Strang, 7th. Edition, published by Van Nostrand Reinhold, 1977. These layers commonly comprise polymers selected from polyvinylacetate, polyvinylchloride, polyvinylbutyral, and polymethylmethacrylate. Other ingredients may be chosen from waxes, polyethylene, alkyd resins, nitrocellulose, ethylcellulose, cellulose acetate, shellac, epoxy resins, styrene-butadiene copolymers, chlorinated rubbers, and polyacrylates. Performance criteria are listed in the Neblette reference above. Such layers are also described in U.S. Pat. Nos. 3,075,859, 3,920,880, 4,201,701 and 4,208,467. The layers should have a thickness in the range 1 μm to 20 μm and preferably in the range 5 μm to 15 μm. The surface of such dielectric layers are advantageously rough to ensure good transfer of charge during the passage under the stylus bar. This roughness can be obtained by including in the layer particles sufficiently large to give surface irregularities to the layer. Particles of diameter in the range 1 μm to 5 μm are suitable. Particle composition is chosen to give the required dielectric constant to the layer. These property requirements of the dielectric layer are well known in the art (see, for example, U.S. Pat. Nos. 3,920,880, and 4,201,701).

The required surface energy characteristics of the imaging sheet may be achieved either by applying a release layer to the free surface of the dielectric, or by modifying the dielectric material. Release layers commonly used in pressure sensitive tape materials, such as polyurethane, were found to have too high adhesion, whereas well known release materials such as dimethylsiloxane were found to be too adhesive. Amongst available materials, polymers incorporating dimethylsiloxane units in small and controlled numbers have been found to perform particularly well.

The release coatings suitable in this invention should have the following properties:

1. No interference with the electrographic imaging characteristics of the dielectric medium.

2. Transfer efficiencies of toners at the last stage in the process should be high, preferably 95% to 100%. It is preferred that no perceptible amount of the release coating should transfer with the toners, because this can interfere with protective overcoats which can optionally be applied to the transferred image.

3. The deposited toners should anchor themselves on the release surface sufficiently to survive the remaining process.

4. No part of the release coating should leach out into the hydrocarbon carrier liquid of the liquid toner and cause poisoning of the toner (the release coating should not be readily soluble or dispersible from a film into the carrier liquid, especially in a time frame of less than 2 minutes).

Image release layers tried included Dow Corning Syl-off TM 7610 (referred to as "preminum release"), and Syl-off TM 7610 based "controlled release". Free silicone in the "controlled release" formulation leached out into the liquid toner and interferred with toner deposition. On the other hand, although the "premium release" formulation did not appear to leach out, its use resulted in considerable abrasive damage to the toner image during the process.

It was concluded that a suitable release layer should have controlled release properties given by incoporating small amounts of moieties such as silicones, but that these silicones should be firmly anchored to a polymer insoluble in the toner carrier liquid. The presence of mobile silicones on the surface of the release layer was found to be unacceptable in giving toner images susceptible to damage during the process. The non-silicone part of the release layer material must have a high softening point. An example of such a polymer is a silicone-urea block polymer with between 1% and 10% by weight of polydimethylsiloxane (PDMS), which is later herein described in reference examples. The polymer was prepared in isopropanol and diluted to 3% solids with further isopropanol for coating on the dielectric surface. Percentages of PDMS above 20% were found to be less preferred because increases in transfer efficiency are negated by decreases in developed image density as PDMS amount increases above 20%. However under less stringent conditions of processing the silicone content can be much higher, even up to 65% or higher.

Other controlled release layer compositions may be obtained using monomers capable of forming condensation products with silicone units through their amine or hydroxy termination groups, the monomer units being polymerized either during or after the condensation. Examples of such compositions are urethane, epoxy, and acrylics in combination with silicone moieties such as PDMS.

Dielectric layers with built-in release properties have added advantages of eliminating an extra coating procedure and eliminating any electrical effects of the thickness of a separate release layer. These intrinsic release dielectric layers can comprise one or more polymers combining self-releasing and dielectric moieties, or can comprise a mixture of a release material and a dielectric polymer or resin.

Successful self-releasing dielectric polymer formulations known to us are later herein described in reference examples. These are copolymers of methylmethacrylate (MMA) with PDMS or terpolymers of MMA, polystyrene, and PDMS. Useful levels of PDMS ranged from 10% to 30% by weight of the total polymer; values in the range 15% to 30% gave transfer efficiencies above 90% but optical density of the deposited toner tended to fall at the higher percentages. An optimum value for these polymers was in the range of 10% to 20%. The silicone-urea material disclosed earlier in this application for use as a separate release layer on a dielectric layer may also be used by itself as a self-releasing dielectric layer. We have shown that PDMS contents of 10 weight % and 25 weight % give good imaging properties and transfer efficiencies above 95%.

Self-releasing dielectric layers comprising a mixture of A) dielectric polymers or resins and B) release materials, have been successfully used in the practice of our invention and are later herein described in reference examples. Included amongst these are mixtures where A) is at least one dielectric polymer such as polystyrene, polymethylmethacrylate, polyvinyl butyral, or styrene/methylmethacrylate copolymers, and B) is at least one silicone-urea block polymer. We have demonstrated that the weight percentage ratio of the PDMS to the total block polymer in B) may be in the range 10% to 50%, and that the ratio of A) to B) can be in the range 90:10 to 25:75. The measured surface energy values for layers of these mixtures all lay in the range 16 to 20 dynes/cm$^2$ and good imaging properties were obtained with high transfer efficiencies, many above 95%. The component B) may alternatively be PDMS itself.

The release entity in either the self-releasing dielectric polymer or the release material in a mixture may be chosen from polymers containing fluorinated moieties such as fluorinated polyethers.

Dielectric layers with built-in release properties have added advantages of eliminating an extra coating procedure and eliminating any electrical effects of the thickness of a separate release layer. There are successful polymer fomulations known to us for this purpose which are later herein described in reference examples. These are copolymers of methylmethacrylate (MMA) with PDMS or terpolymers of MMA, polystyrene, and PDMS. Useful levels of PDMS ranged from 10% to 30% by weight of the total polymer; values in the range 15% to 30% gave transfer efficiencies above 90% but optical density of the deposited toner tended to fall at the higher percentages. An optimum value for these polymers was in the range of 10% to 20%.

Physical Requirements on a Separate Release Layer

The operative surface of the imaging sheet, apart from being of a specific adhesive power, must have a controlled roughness to facilitate charging as was described above for the dielectric layer itself. When release properties are provided by a separate layer coated over the dielectric layer, the release layer must provide the requisite roughness by following the topography of the original dielectric surface.

When a separate release layer is used, its thickness must be carefully controlled; too low a thickness results in imperfect transfer whereas too high a thickness can interfere with the electrostatic image receiving properties of the surface. A suitable range is apparently 0.05 μm to 2 μm. The preferred thickness range is 0.08 μm to 0.3 μm. Between the characteristics of an uncoated dielectric surface and the characteristics of the same dielectric surface after coating with a release layer according to this invention, no significant change is found in the roughness of the surface after coating compared with that before coating.

The following example illustrates the relationships between the coating weight (and hence the dry thickness) of the release layer on the imaging sheet, the surface charge (measured as surface potential) deposited by charging styli, the developed image density, and the image transfer efficiency.

Syloff 23 TM ("premium release") silicone solutions in heptane were coated on 2089 Type dielectric paper (produced by James River Graphics Corp.) in such a manner that only a part of the 22" wide paper received the coating. The purpose of partial coating was to be able to image both coated and uncoated portions of the paper simultaneously. Different solution concentrations and different size wire-wound coating rods (Meyer rods) were used to produce coatings of varying thickness. In these experiments the coating weight of the release layer was calculated from the solution concentration and the size of the coating bar using published wet layer thicknesses resulting from various size Meyer bars, i.e. a more concentrated solution or a larger bar number (#) produces a thicker release layer.

The coated imaging sheet was charged and developed using a Benson 9322 printer. The surface potential on the imaging sheet was measured with an electrostatic voltmeter probe mounted between the charging and liquid developer stations in the printer, and Benson's T3 black liquid toner was used for image development.

After measuring the optical density (OD) in background and image areas of the developed imaging sheet, the toner image was transferred to a commercially available receptor paper coated with a thermoplastic material (Schoeller 67-33-1 which has a surface coating of a polymerized ethylene acrylic acid available commercially as Primacor EAA) using heat and pressure. The residual optical density remaining in background and image areas on the imaging sheet was measured again after transfer. Image transfer efficiency was calculated using the formula $$\text{Transfer Efficiency (\%)} = 1 - \left\{ \frac{OD_r - OD_{Br}}{OD - OD_B} \right\} \times 100$$

where OD is the image optical density on the imaging sheet before transfer, $OD_r$ the residual optical density in the image area after the image has been transferred, $OD_B$ the optical density in the background area before transfer, and $OD_{Br}$ is the residual optical density in the background area after transfer.

Table 1 shows the progressive reduction of the developed optical density OD as the thickness of the release layer on the imaging sheet surface was increased. Table 2 shows the effect of the release layer on surface potential and image transfer efficiency. Increased release layer thickness results in increased image transfer efficiency, but there was a decrease in the surface potential and, consequently, in the resulting image density.

TABLE 1

REDUCTION OF IMAGE OD BY A RELEASE LAYER.

| Reference Area. (no release layer) OD | Areas Coated with Release Layer Composition. Coating Conditions | Nominal Thickness μm | OD | % decrease in OD |
|---|---|---|---|---|
| 1.584 | 4% #7 | 0.9 | 1.544 | 2.53 |
| 1.588 | 4% #8 | 1.0 | 1.507 | 5.10 |
| 1.582 | 4% #10 | 1.1 | 1.501 | 5.12 |
| 1.582 | 5% #8 | 1.25 | 1.450 | 8.34 |
| 1.584 | 5% #10 | 1.38 | 1.472 | 7.01 |
| 1.576 | 5% #12 | 1.45 | 1.335 | 15.29 |

TABLE 2

EFFECT OF RELEASE LAYER THICKNESS ON SURFACE POTENTIAL AND TRANSFER EFFICIENCY.

| Nominal Coating Thickness in μm | Surface potential V in volts | $OD_B$ | OD | $OD_{Br}$ | $OD_r$ | % Transfer efficiency |
|---|---|---|---|---|---|---|
| 0.9 | 150 | 0.071 | 1.544 | 0.152 | 0.190 | 97.42 |
| 1.0 | 150 | 0.077 | 1.507 | 0.086 | 0.101 | 98.95 |
| 1.1 | 150 | 0.076 | 1.501 | 0.127 | 0.118 | 100.00 |
| 1.25 | 140 | 0.083 | 1.450 | 0.097 | 0.096 | 100.00 |
| 1.38 | 140 | 0.080 | 1.472 | 0.121 | 0.127 | 99.57 |
| 1.45 | Not available | 0.080 | 1.335 | 0.094 | 0.093 | 100.00 |

Toners

Liquid toners for use in this invention may be selected from types conceptually well known in the art. These toners comprise a stable dispersion of toner particles in an insulating carrier liquid which is typically a hydrocarbon. The toner particles carry a charge and comprise a polymer or resin and a colored pigment. However they preferably should satisfy the following general requirements in addition to the interfacial surface energy and scratch strength requirements laid down earlier in this disclosure. These general requirements are discussed in some detail in copending U.S. patent application Ser. No. 279,424 filed on Dec. 2, 1988. The requirements are:

a) a ratio of less than 0.6, preferably less than 0.4 and most preferably less than 0.3 between the conductivity of the carrier liquid as present in the liquid toner and the conductivity of the liquid toner itself, and b) toner particles with zeta potentials in a narrow range and centered between +60 mV and +200 mV.

The liquid toner preferably also should satisfy the following requirements c) deposited toner particles have a $T_g$ less than 100° C. and greater than −20° C., and more preferably less than 70° C. and greater than −10° C., d) substantially monodispersed toner particle sizes with an average diameter in the range 0.1 micron to 0.7 micron, e) a conductivity in the range of $0.1\times10^{-11}$ mho/cm and $20\times10^{-11}$ mho/cm with solids concentration in the liquid toner in the range 0.5 wt % to 3.0 wt. % and preferably 1.0 wt. % to 2.0 wt. %.

The insulating carrier liquid in these liquid toners has been found in our work to have further importance related to the robustness of the deposited toner layers during the process as predicted by the scratch test strength. There exists a comprehensive series of hydrocarbon carrier liquids (e.g. the Isopar TM series) with a range of boiling points. Isopar TM liquids C, E, G, H, K, L, M, and V have boiling points respectively of 98°

C., 116° C., 156° C., 174° C., 177° C., 188° C., 206° C., and 255° C. Mixtures of different members of such a series are often used in liquid toner formulations. We have found that in the presence of high boiling members, lower robustness results and low scratch test strengths are exhibited. In particular we have found that high fractional amounts of Isopar TM L as opposed to Isopar TM G tend to be deleterious.

Toners are usually prepared in a concentrated form to conserve storage space and transportation costs. In order to use the toners in the printer, this concentrate is diluted with further carrier liquid to give what is termed the working strength liquid toner.

The toners may be laid down on the imaging sheet surface in any order, but for colorimetric reasons, bearing in mind the inversion which occurs on transfer, it is preferred to lay the images down in the order black, cyan, magenta, and yellow. Printers used previously in the art (including the Synergy printer) laid down the toners with black first also, but since no transfer was used, the final image had black at the bottom of the image assembly. Because lighter and generally more scattering color toners can occur on top of the black, the appearance of the resulting image color was desaturated. In our assembly the black appears as the top toner which gives full depth to the colors.

Preparation of Toners

1. Preparation of stabilizer containing chelating groups and grafting sites.

A 500 ml 3-necked round bottom flask, equipped with a stirrer, thermometer and a condenser connected to a nitrogen source, was charged with a mixture of 69 g laurylmethacrylate (LMA), 4.5 g 5-methacryloxymethyl-8-hydroxyquinoline (HQ), 1.5 g 2-hydroxylethylmethacrylate (HEMA) and 175 g of Isopar H. The mixture was flushed with nitrogen and heated to 70° C. with stirring until the quinoline monomer dissolved.

1.5 g of 2,2'-azo-bisisobutyronitrile initiator (AIBN) were then added to the solution and the mixture polymerized at 70° C. for about 20 hours. The conversion was quantitative.

After heating to 90° C. for 1 hour to destroy any residual AIBN, the mixture was cooled to room temperature, the nitrogen source replaced with a drying tube and equal molar amounts, i.e. 1.8 g of 2-isocyanatoethylmethacrylate (IEM) and 0.36 g of dibutyltindilaurate, were added to the flask. The mixture was then stirred at room temperature for 24–48 hours. The conversion is quantitative, and the resulting stabilizer solution can be used to prepare the organosol.

The product is a copolymer of LMA, HQ and HEMA and contains side chains of IEM. It is designated as LMA/HQ/HEMA-IEM.

2. Preparation of organosol containing poly-vinyltoluene core.

Case A

A reaction flask, equipped as described in Example 1, was charged with 110 g of LMA/HQ/HEMA-IEM stabilizer, 33 g of vinyltoluene, 457 g of Isopar TM H and 0.66 g of AIBN and the resulting mixture polymerized at 70° C. for 21 hours. The conversion rate was 56%. After stripping residual monomer under vacuum, the product was ready to be used as binder in liquid toner preparations.

Case B

In the setup described in Example 1, the flask was charged with a mixture of 110 g of the stabilizer (LMA/HQ/HEMA-IEM=92.8/2.9/2.0–2.3, 30% solids), 33 g of vinyltoluene (VT), 457 g of Isopar TM H and 0.5 g of t-butylperoxide. The resulting solution was flushed with nitrogen for 10 min. and then polymerized at 130° C. for 8.5 hours. The conversion yield is 95.3% and the dispersion contains 10.74% solids.

The product is an organosol of poly(vinyltoluene) containing long grafts of LMA, HQ and HEMA copolymer. It is designated as LMA/HQ/HEMA-IEM//VT.

3. Preparation of a black toner for use with silicone coated dielectric paper.

A toner concentrate containing 15% solids was prepared by mixing BK-8200 carbon black pigment and LMA/HQ/HEMA-IEM//VT organosol (feed composition: 45.90/1.95/0.98-1.17//50.0) in 1:1 ratio in Isopar TM H and bead milling the dispersion to reduce the average particle size to 367+/−114 nm. Zr neodecanoate charging agent was then added at a 0.238% level of the dispersion.

The concentrate was diluted with Isopar TM G and additional organosol and Zr neodecanoate were added to prepare the working strength toner with the following properties:

organosol/BK-8200 weight ratio: 2.0,
solids concentration: 2.0%,
Zr neodecanoate: 0.147 to 0.2%,
specific conductivity: $12.4\times10^{-11}$ to $15.9\times10^{-11}$/ohm.cm.

Good image adhesion to silicone coated dielectric paper was obtained using Synergy Colorwriter 400 printer. The reflection optical density (ROD) of the image was 1.14 or higher.

4. Black liquid toner for use with urea-silicone coated dielectric paper.

Toner concentrate was prepared by dispersing Regal 300R carbon black pigment in LMA/HQ/HEMA-IEM//VT (feed composition: 44.92/2.93/0.98-1.17//50) organosol using bead mill to produce an average particle size of about 306 nm. The organosol to carbon black weight ratio was 1.0 and the solids concentration 15%.

A 1.08% working strength toner was prepared by diluting the concentrate with Isopar TM G, adding Zr neodecanoate and more organosol to increase the organosol to pigment ratio to 2.0. The Zr neodecanoate concentration in the toner was 0.13%.

The toner had a specific conductivity of $7.98\times10^{-11}$/ohm.cm and it produced images on urea/silicone coated dielectric paper with a ROD of 1.41.

5. Cyan liquid toner for use with urea-silicone coated dielectric paper.

15% solids concentrate was prepared by bead milling a 1:1 mixture of LMA/HQ/HEMA-IEM//VT (45.85/0.97/1.45-1.74//50.0 feed composition) organosol and Sunfast 248-3750 cyan pigment in Isopar TM H.

The concentrate was diluted with Isopar TM G and Zr neodecanoate and additional organosol were added to prepare a working strength toner containing 1% solids. The toner had the following properties:

organosol:pigment weight ratio=2.0,
Zr neodecanoate: 0.028%,
particle size: 337+/−91 nm,
specific conductivity: $7.02\times10^{-11}$/ohm.cm,
image ROD: 1.18.

6. Magenta liquid toner for use with urea-silicone coated dielectric paper.

15% toner concentrate was prepared by dispersing Monastral 796D magenta pigment in LMA/HQ- /HEMA-IEM//VT (45.85/0.97/1.45-1.74//50.0 feed composition) organosol using a bead mill.

The toner concentrate was diluted with Isopar TM G and Zr neodecanoate and additional organosol were added to prepare a 1.15% working strength toner with the following properties:
organosol/pigment weight ratio: 2.0,
particle size: 456+/−158 nm,
specific conductivity: $3.90\times10^{-11}$/ohm.cm,
image ROD: 1.13.

7. Yellow liquid toner for use with urea-silicone coated dielectric paper.

The toner concentrate was prepared as described in Example 6 using the following pigment and organosol:
pigment: Sun's 274-1744 AAOT yellow,
organosol: LMA/HQ/HEMA-IEM//VT (45.85/0.97/1.45-1.74//50 feed composition).

The concentrate was diluted with Isopar TM G and Zr neodecanoate and additional organosol were added to prepare a 1.0% working strength toner with the following properties:
organosol/pigment weight ratio: 2.0,
particle size: 388+/−87 nm,
Zr neodecanoate: 0.014%,
specific conductivity: $1.31\times10^{-11}$/ohm.cm,
image ROD: 1.09.

The black, cyan, magenta, and yellow toners described in 4 to 7 above were used in the Synergy Colorwriter 400 printer to print test patches of all single color and overlaying color combinations on release coated dielectric paper (silicone/urea composition release layer). A high quality image was obtained, i.e., there were no scratch marks and the toners showed good overprinting capability for producing composite colors. The image was thermally transferred to modified Scotchcal TM image receptor (a 30 micrometer thick butylmethacrylate topcoat was applied to the surface of the polyvinylchloride top layer of Scotchcal TM ) without leaving a residue on the release surface of the imaging sheet.

Receptor sheets

These sheets comprise a substrate, generally with special requirements on its properties, and a coated layer on one surface of the substrate giving the necessary surface energy level together with the $T_g$ value specified above. To ensure adequate conformation with the surface of the imaging sheet, this layer should also have suitable complex dynamic viscosity. The surface coating of the receptor sheet may be chosen from a wide range of thermoplastic polymers which conform to the requirements described above. Examples of such materials are acrylates and especially methacrylates such as methyl acrylates, butyl methacrylates, methyl methacrylate copolymers with other acrylates, ethyl methacrylates, isobutyl methacrylates, vinyl acetate/vinyl chloride copolymers of low molecular weight, and aliphatic polyesters. Examples of materials which do not give satisfactory transfer are high molecular weight polymethyl methacrylates. The complex viscosity of polymers is known to be a function of their molecular weight (see page 69 of "Polymer Rheology", by L. E. Nielsen, published by Marcel Dekker, 1977.). At low molecular weights, say below 40,000, the complex viscosity is directly proportional to the molecular weight. At higher molecular weights the viscosity is a power function of the molecular weight with an index of about 3.4. Therefore high molecular weight polymers are not likely to be suitable for the receptor coatings of this invention.

Rheological evaluation of receptor materials was carried out on a Rheometrics Mechanical Spectrometer, model RMS-605. The instrument was calibrated with polydimethylsiloxane (GE #SE30) to yield rheological functions in agreement with those described in the Rheometrics Mechanical Spectrometer Operations Manual, Rheometrics Inc., Issue 0381, pages 6–10. The complex viscosities were obtained by oscillatory parallel plate measurements carried out with a strain of 2% at a frequency of 10 radians/sec. at a temperature of 110° C. Samples of films used were either taken from commercially produced material (e.g., 3M standard cast white vinyl) or were cast from solution, air dried, and then further dried for 3 to 5 days in a vacuum oven at temperatures selected to be about equal to or less than the $T_g$ of the material. Measurement samples of these receptor materials were prepared consisting of layered films compressed at 110° C. between the serrated parallel plates of 25 mm diameter to give a gap of thickness in the range 0.5 mm to about 2.0 mm.

The image transfer efficiency of a range of receptor sheets was determined by measuring the amount of toner left on the imaging sheet after the transfer process had been carried out at 110° C. and a pressure of 1 atmosphere for 5 minutes in a vacuum drawdown apparatus. Since the residual toner on the imaging sheet after transfer caused the color of the surface to appear different from the background, i.e. areas which did not contain any image, the measurement of the "CIELAB color difference", normally designated by ΔE, gave a good estimate of the image transfer efficiency, low values signifying good transfer. (For a description of ΔE see page 68 of "Measuring Color", by R. W. G. Hunt, published by John Wiley & Sons, New York 1987.). The imaging sheets and their corresponding receptor sheets were also assessed visually to determine acceptability and ranking order.

The color difference ΔE was measured using a Macbeth "Color Eye" spectrophotometer on areas of the imaging sheet surface from which toner images had been transferred. The measurement aperture was 7 mm×7 mm. Areas from which black patches had been transferred were used in these measurements.

Table 3 gives values of complex dynamic viscosity and shear modulus for various receptor coating materials, and relates these values to the transfer properties experienced in this invention measured on the ΔE scale.

TABLE 3

RHEOLOGICAL EVALUATION OF RECEPTOR COATING MATERIALS.

| SAMPLE | Complex viscosity in $10^5$ poise | $T_g$ | Transfer efficiency ΔE |
|---|---|---|---|
| Clear unpigmented materials. | | | |
| Elvacite TM 2044 | 1.06 | 15 | 1 |
| Elvacite TM 2010 | 4.6 | 98 | 6 |
| Acryloid TM A21 | 3.3** | 105 | 8 |
| Clear cast vinyl | 5.0 | 20 | 8 |
| Elvacite TM 2041 | 6.3* | 95 | 15 |
| Pigmented materials. | | | |
| 8942/8951 1:1 | 1.6 | — | 3 |
| 8942 white | 3.0 | — | 5 |

TABLE 3-continued

RHEOLOGICAL EVALUATION OF RECEPTOR COATING MATERIALS.

| SAMPLE | Complex viscosity in $10^5$ poise | $T_g$ | Transfer efficiency ΔE |
|---|---|---|---|
| Standard cast white vinyl | 6.0 | 18 | 16 |

Notes on materials used:
Elvacite TM 2044 by DuPont is polybutyl methacrylate with $T_g$ = 15° C.
Elvacite TM 2010 by DuPont is polymethyl methacrylate with $T_g$ = 98° C.
Elvacite TM 2041 by DuPont is polymethyl methacrylate with $T_g$ = 95° C.
*value calculated from "Polymer Rheology", L. E. Nielsen, published by Dekker (1977) using weight average molecular weight of 323,000 published by Du Pont.
Acryloid TM A21 by Rohm & Haas is polymethyl methacrylate with $T_g$ = 105° C.
**this value is questionable and probably too low because of bubbles in the assembled sample used for measuring complex dynamic viscosity.
Clear cast vinyl (polyvinyl chloride) by 3M.
8951 by 3M is a clear blend of 4:1 PVC and acrylic resin.
8942 by 3M is a white 4:1 blend of PVC and acrylic resin pigmented with $TiO_2$.
Standard white vinyl is manufactured by 3M.

The ΔE range was correlated with the visual assessment and a value of 4 was found to relate to transferred images which were just unacceptable. It is therefore defined for this invention that the ΔE value should be below 4. From values in Table 3 the graph in FIG. 2 was drawn showing complex dynamic viscosity plotted against ΔE values. A second order regression line was drawn through the data points and is shown in FIG. 2. Using the visually determined upper limit of 4 for ΔE, from FIG. 2 it is seen that the value of complex dynamic viscosity should be less than about $2.5\times10^5$ poise for good transfer by vacuum drawdown giving a pressure of about 1 atmosphere. Preferably the value should be less than about $2.0\times10^5$ poise. These values were obtained at 110° C. and the related transfers were made at that temperature. The same complex dynamic viscosity limit would be expected to apply at other transfer temperatures as long as the value was obtained at that temperature. Our tests have indicated that as transfer temperature is raised borderline unacceptable receptor surfaces give better results. This would be expected from the published literature showing a gradual fall in the complex dynamic viscosity with increasing temperature (see L. E. Nielsen reference above).

The substrate preferably should be conformable to the microscopic undulations of the surface roughness of the imaging surface. Materials such as PVC conform to the imaging surface well whereas materials such as polycarbonate do not and consequently give bad transfer of the toner image. Other materials which may be used as substrates are acrylics, polyurethanes, polyethylene/acrylic acid copolymers, and polyvinyl butyrals. Commercially available composite materials such as Scotchcal TM, and Panaflex TM are also suitable substrates. However some substrates such as polyesters and polycarbonates which appear to be too stiff to give microconformability can be made useful as receptors in this invention by coating a sufficiently thick layer of the materials with a suitable $T_g$ and a complex dynamic viscosity in the range defined above. On substrates such as PVC the coated layer thickness can be as low as 3 micrometers whereas on Scotchlite TM retroflective material a coated layer thickness of 30 micrometers may be required.

Transfer conditions.

The preferred device for transfer in this invention is the vacuum drawdown frame. Typical pressures and temperatures in such a device when used in this invention are 1 atmosphere and 110° C. The pressure is defined by the normal ambient air pressure but means to increase the local ambient pressure could provide higher transfer pressures in the vacuum drawdown apparatus. Temperatures in a range of at least 90° C. to 130° C. may be used by selecting the receptor layer material according to the requirements given above. This method is preferred because there is no resulting distortion of the image during transfer either by flow of the receptor sheet coating or by the squeezing of the receptor substrate. With the nip roller transfer technique distortion is very likely to occur because of the higher pressures involved; on the other hand, complete transfer is more easily achieved and the specification of the receptor coating properties is less stringent. In this invention the vacuum drawdown technique is preferred because of the lack of distortion of the final image but the receptor properties must therefore be carefully controlled.

Protective overcoats.

Overcoating of the transferred image may optionally be carried out to protect against physical damage and/or actinic damage of the image. These coatings are compositions well known in the art and typically comprise a clear film-forming polymer dissolved or suspended in a volatile solvent. An ultraviolet light absorbing agent may optionally be added to the coating solution. Lamination of protective coats to the image surface is also well known in the art and may be used in this invention.

Surface energy measurements.

a) Sample preparation.

Release Coatings.

Films of release coatings were deposited on clean glass plates (24 mm×60 mm×1 mm) by dip coating solutions (3%–5% solids) of the test materials. In some cases the coatings had to be dried at 40° C. in a low relative humidity (40%) environment to obtain clear films.

On dielectric paper the release coatings were applied by coating the solutions with a coating rod (#0 Meyer bar). The sample plates required for contact angle measurements using the Wilhelmy technique (L. Wilhelmy, *Ann. Physik*, 119 (1863) 177) were then prepared by bonding the coated paper to both sides of a 24 mm wide polyester film support in such a manner that after immersion only the release coated surface can come in contact with the test liquid.

Receptor surfaces.

Test plates of receptor materials were prepared by dip coating clean microscope slides. However, if only an adhesive-backed film of the material was available, the test plate was prepared by removing the protective liner from the adhesive and bonding two 24 mm wide strips together (back to back) so that only the surface of interest is presented to the test liquid.

Liquid Toner Materials.

Continuous, smooth liquid toner films were prepared by electroplating toner particles from their dispersions in Isopar TM G carrier liquid onto anodized and silicated aluminum plates. The particle deposition was done at −150 volts applied to the aluminum substrate using plating times of 10 seconds to 60 seconds depending upon the characteristics of the specific toner dispersion. After electroplating, the plates were rinsed by dipping in clean Isopar TM and dried in air at room temperature.

b) Contact angle measurements.

A Cahn-322 Model Dynamic Contact Angle Analyzer was used to measure the advancing and receding contact angles of the wetting liquid on the surface of the Wilhelmy plate. Advancing contact angles were measured at 3-5 different regions of the surface of the Wilhelmy plate and the values were found to be reproducible within an error of less than ±1% in most cases and ±2% in a few cases. At least 4 liquids of widely different $\gamma^d$ and $\gamma^p$ were used as the wetting liquids for each test surface.

c) Calculation of surface energy from contact angle data.

From the measured advancing contact angles $\theta$ of test liquids with known $\gamma_i^d$ and $\gamma_i^p$ on the solid surface, the surface energy is calculated from the equation (H. Y. Erbil and R. A. Meric, Colloids & Surfaces, 33, (1988) 85-97, and the original references cited therein):

$$\cos\theta_i = -1 + 2[(\gamma_i^d \cdot \gamma_j^d)^{\frac{1}{2}} + (\gamma_i^p \cdot \gamma_j^p)^{\frac{1}{2}}]/\gamma_i$$

where i indicates liquid and j indicates solid.
and $\gamma_i = \gamma_i^d + \gamma_i^p$
where i=1,2, . . . n and n is the number of test liquids in a set with surface energy values published in the art covering a range of polarities, The values of the surface tension $\gamma^{total}$ and the dispersion and polar components of the surface tension $\gamma^d$ and $\gamma^p$ for various test liquids were taken from Kaelble, et. al (D. H. Kaelble, P. J. Dynes and L. Maus, J. Adhesion, 6, (1974), 239-258) (See Table 1). The values for ethylene glycol were measured with the Wilhelmy balance using test solids with known properties.

d) Work of adhesion.

Thermodynamic work of adhesion ($W_a$) between the release layers and toner films was calculated from:
$W_a = 2[(\gamma_s^d \cdot \gamma_t^d)^{\frac{1}{2}} + (\gamma_s^p \cdot \gamma_t^p)^{\frac{1}{2}}]$
$\gamma_s$=Surface energy of Release layer
$\gamma_t$=Surface energy of Toner film
For calculation of the polar component of the work of adhesion, $W_a$-Polar, the equation $W_a^p = 2[(\gamma_s^p \cdot \gamma_t^p)^{\frac{1}{2}}]$ was used.

e) Interfacial tension between polymer layers.

The interfacial tension between polymer layers 1 and 2 was calculated from the Fowkes Equation (S. Ross and I. D. Morrison in "Colloidal Systems and Interfaces" (1988), John Wiley & Sons):

$$\sigma_{12} = \sigma_1 + \sigma_2 - W_{12}$$

where $\sigma$ values refer to the surface tension and $W_{12}$ to the work of adhesion between surfaces 1 and 2.

f) Spreading coefficient (Girifalco-Good) $\Phi$.

$$\Phi = Wa/2(\gamma_s \cdot \gamma_t)^{\frac{1}{2}}, \text{ where } \gamma_s = \gamma_s^d + \gamma_s^p, \text{ and } \gamma_t = \gamma_t^d + \gamma_t^p$$

where $\Phi$=1 for complete spreading,
$\Phi$<1 for less spreading (poor adhesion)
Release Index=1/$\Phi$
Ease of layer release is proportional to 1/$\Phi$ Surface energy measurements were made on a series of materials which were candidates for use in this invention. Values for the silicone-urea release layers described above are presented in Table 4, and values for a selected set of other candidate surfaces are given in Table 5.

TABLE 4

SURFACE ENERGIES OF RELEASE LAYERS

| SILICONE-UREA RELEASE LAYER | $\gamma^d$ ergs/cm² | $\gamma^p \times 10^2$ ergs/cm² | $\gamma^{total}$ ergs/cm² | COMMENTS |
|---|---|---|---|---|
| 0% PDMS | 21.7 | 580 | 27.6 | on glass |
| 1% PDMS | 17.2 | 105 | 18.3 | on glass |
| 3% PDMS | 17.2 | 45.2 | 17.7 | on glass |
| " | 17.0 | 20.0 | 17.2 | on paper |
| " | 16.7 | 36.2 | 17.1 | on paper heated 220° F. for 5 min |
| 10% PDMS | 15.9 | 47.7 | 16.4 | |

TABLE 5

SURFACE ENERGIES OF DIELECTRIC PAPER AND OTHER RELEASE SURFACES.

| SURFACE | $\gamma^d$ ergs/cm² | $\gamma^p$ ergs/cm² | $\gamma^{total}$ ergs/cm² | COMMENTS |
|---|---|---|---|---|
| Type 1 paper | 16.5 | 0.32 | 16.9 | Coated with 10% PDMS. |
| Heated | 16.5 | 0.46 | 17.0 | 220° F. for 5 min. |
| Type 6 paper | 27.8 | 0.60 | 28.4 | No release layer. |
| Type 3 paper | 14.6 | 0.01 | 14.7 | Coated with Premium Release in heptane. |
| PVC on substrate | 22.3 | 1.5 | 23.7 | Scotchcal TM |
| PVC Heated | 23.7 | 2.9 | 26.6 | 220° F. for 5 min. |
| Type 4 paper | 21.2 | 0.07 | 21.2 | Urethane. |

Work of adhesion of toners to release surfaces can be calculated from the surface energies by the equation given in the discussion above (d. Work of Adhesion). These values $W_a$ are a measure of the relative adhesion-/adhesion of two surfaces in an overlay of toner(s) on a surface. Tables 6 and 7 show these values for toner/-release-layer and toner/toner respectively. Table 8 gives values for $W_a$ between toner layers and uncoated dielectric paper—Type 6 paper in Table 5. These are seen to be much higher than the values with an added release layer in Table 6 even with as low a PDMS level as 1%. On the other hand the values in Table 8 are very similar to the values of adhesion between toner layers as seen in Table 7.

TABLE 6

WORK OF ADHESION ($W_a$) OF TONERS TO RELEASE LAYERS

| TONER | $W_a$ to 1% PDMS ergs/cm² | $W_a$ to 3% PDMS ergs/cm² | $W_a$ to 10% PDMS ergs/cm² | $W_a$ to 0% PDMS ergs/cm² | $W_a$ to uncoated dielectric paper ergs/cm² total | polar |
|---|---|---|---|---|---|---|
| B-1 black | 55.3 | 52.9 | 51.1 | 71.1 | 66.5 | 5.5 |
| C-1 cyan | 45.2 | 44.8 | 43.1 | 52.2 | 56.8 | 0.9 |
| M-1 magenta | 44.3 | 43.9 | 42.2 | 51.6 | — | — |
| Y-1 yellow | 50.8 | 48.6 | 47.0 | 65.0 | 61.3 | 4.9 |
| B-2 black | 50.9 | 48.7 | 47.0 | 65.3 | 61.3 | 5.0 |
| M-2 magenta | 48.0 | 45.9 | 44.3 | 61.8 | 57.8 | 4.8 |

TABLE 6-continued

| TONER | WORK OF ADHESION ($W_a$) OF TONERS TO RELEASE LAYERS | | | | | |
|---|---|---|---|---|---|---|
| | $W_a$ to 1% PDMS ergs/cm$^2$ | $W_a$ to 3% PDMS ergs/cm$^2$ | $W_a$ to 10% PDMS ergs/cm$^2$ | $W_a$ to 0% PDMS ergs/cm$^2$ | $W_a$ to uncoated dielectric paper ergs/cm$^2$ total | polar |
| B-3 black | 52.9 | 50.5 | 48.9 | 67.7 | — | — |
| B-4 black | 52.7 | 50.6 | 48.8 | 66.8 | — | — |
| C-2 cyan | 46.1 | 45.2 | 43.6 | 54.8 | — | — |
| M-3 magenta | 43.5 | 43.0 | 41.3 | 51.3 | — | — |
| Y-2 yellow | 45.9 | 44.3 | 42.7 | 57.3 | — | — |

TABLE 7

| TONERS LAYERS | WORK OF ADHESION ($W_a$) BETWEEN TONER LAYERS. (OVERPRINTING). | | | | |
|---|---|---|---|---|---|
| | $W_a$ (total) ergs/cm$^2$ | $W_a$ (Polar) ergs/cm$^2$ | $\Phi$ | $1/\Phi$ | Inter-facial Tension |
| B-1-C-1 | 65.5 | 4.2 | 0.9041 | 1.1060 | 9.1 |
| B-2-C-1 | 60.3 | 3.8 | 0.9060 | 1.104 | 7.1 |
| C-1-Y-1 | 60.4 | 3.7 | 0.9133 | 1.0949 | 6.5 |
| M-1-Y-1 | 59.8 | 4.5 | 0.924 | 1.0823 | 5.9 |
| C-1-M-1 | 55.6 | 0.8 | 1.006 | 0.9994 | 0 |
| B-1-M-2 | 80.3 | 22.2 | 1.0000 | 1.0000 | 0.8 |
| M-2-Y-1 | 73.3 | 19.6 | 0.9998 | 1.0001 | 0.1 |
| B-1-M-1 | 64.9 | 5.1 | 0.9161 | 1.0915 | 8.5 |
| C-1-M-2 | 56.8 | 3.5 | 0.9020 | 1.1085 | 6.5 |
| B-1-Y-1 | 84.3 | 22.4 | 0.9998 | 1.0002 | 1.6 |
| B-2-M-2 | 73.8 | 20.1 | 0.9988 | 1.0011 | |

TABLE 8

| TONER LAYERS | WORK OF ADHESION BETWEEN TONER LAYERS AND UNCOATED DIELECTRIC PAPER (Type 6 Paper) | |
|---|---|---|
| | $W_a$ (total) ergs/cm$^2$ | $W_a$ (polar) ergs/cm$^2$ |
| B-1 black | 66.5 | 5.5 |
| C-1 cyan | 56.8 | 0.9 |
| B-2 black | 61.3 | 5.0 |
| M-2 magenta | 57.8 | 4.8 |
| Y-1 yellow | 61.3 | 4.9 |
| Y-3 yellow | 56.0 | 4.3 |
| C-3 cyan | 67.1 | 4.6 |
| Y-4 yellow | 69.1 | 5.5 |
| M-4 magenta | 63.6 | 5.5 |

Implications of the Surface Energy measurements.

The effects of good and bad release properties in the imaging sheet surface can be affected by a number of image toner deposition conditions differing in the type and number of the four toners involved. With a 10% PDMS release coat all three toners will release together whereas with a 0% PDMS release coat the there will be a split at the M-C interface. In the sixth image the split would be at the Y-C interface and for the second image at the C-B interface. All the other image conditions would transfer by splitting at the interface with the dielectric coat surface so that all the toners are transferred. When the proper release layer is used, none of the image conditions will show splitting within the toner assembly but only at the release surface.

This analysis, however, assumes that the cohesive strength of the toner layers themselves is such that no splitting can occur within a toner layer. Cohesive strengths are obtained by twice the surface energy of the toner layer (see relationship of work of adhesion to polar and dispersive components of the surface energies of the two surfaces, given above, and remembering that in the bulk of a single material the two sets of surface energy values are identical). These, like the work of adhesion, must be more than the work of adhesion of the bottom toner to the dielectric (release) surface.

A final criterion needs to be set for success in the imaging process. During the process itself the deposited toners must be tough enough to resist the abrasion they encounter from the stylus bars and developing rollers. The scratch tests described in the next section give a means to determine whether the abrasive strength of the toners is sufficient for this purpose.

Scratch tests.

The following is a description of procedures for liquid toner films.

a) Sample Preparation.

A 35 mm wide and 95 mm long strip of 76 micrometer thick polyester film, provided on one side with a vapor-coated layer of aluminum, is placed in a cell filled with liquid toner dispersion (1%–2% solids) in such a manner that the aluminum side is spaced 5 mm away from a counterelectrode. After connecting the aluminum layer to the negative and the counterelectrode to the positive terminal of a DC power source, a potential of 150 volts is applied for 20 seconds to cause electrophoretic deposition of toner particles onto the aluminum layer.

After toner deposition the sample is rinsed by dipping in Isopar TM G and air-dried for 5 to 7 minutes to remove excess liquid from the toner layer.

The scratch test is performed immediately after the liquid film has evaporated in order to examine the toner layer properties under conditions which approximate those in the electrostatic printer when the transfer medium bearing image of the first color has just arrived at the imaging station for the second color where the first image will be exposed to frictional contact with the charging head, rotating development electrode and the edges of the vacuum port.

b) Scratch Test Procedure.

The scratch test consists of a stylus, loaded down with weights, being pulled over the toner layer surface. The radius of curvature for the stylus tip (ball bearing) is about 0.75 mm and the weights can be adjusted to change the load on the toner layer surface.

The marks on the toner layer surface made by the stylus are examined under a microscope (194×magnification) and classified as follows (in increasing degree of damage):

(C) toner layer is only compressed.

(Scr) layer compression plus fine scratch lines.

(Cr) toner layer compressed and cracking.

(S) stylus "skips", partial layer removal.

(TR) total layer removal over wide contact area.

A toner layer which cracks or exhibits "skipping" at lower stylus load than another toner layer is interpreted as being mechanically weaker.

Scratch Strength for this invention is defined as the load in grams required to produce damage up to a level of Cr.

TABLE 9

RESULTS OF SCRATCH TESTS.

| TONER | SCRATCH DEGREE | LOADINGS IN GRAMS <2 mins | <8 mins | <24 hrs |
|---|---|---|---|---|
| B-2 | Tr | | 30 | 20 |
| | S | | 20 | 20 |
| | Cr | | | |
| | Scr | | | |
| | C | | 20 | 20 |
| B-1 | Tr | | 90 | 30 |
| | S | | 50 | |
| | Cr | | | |
| | Scr | | | |
| | C | 40 | 40 | 20 |
| B-5 | Tr | | | |
| | S | | 140 | 80 |
| | Cr | | 140 | 40 |
| | Scr | | | |
| | C | 130 | 140 | 40 |
| Y-1 | Tr | | 330 | 140 |
| | S | | | 120 |
| | Cr | | 320 | 100 |
| | Scr | | | |
| | C | | 320 | 100 |
| C-1 | Tr | | | 400 |
| | S | | | 360 |
| | Cr | | | 350 |
| | Scr | | | |
| | C | | 330 | 350 |
| M-2 | Tr | | | |
| | S | | | |
| | Cr | | | |
| | Scr | | 420 | |
| | C | | 400 | |

Tr = Total removal, S = Skipping with removal, Cr = Cracking, Scr = Scratching, C = Compression.

Test Procedure for Dielectric Release Coating

The "self-releasing" dielectric constructions were electrostatically charged and developed using a Benson 9323 single station electrostatic printer. A black "B 51" liquid toner, produced by Hilord Chemical Corporation, was used for image development.

The electrographic performance of a dielectric construction was considered acceptable if the developed image had a reflective optical density of about 1.4 and the density was uniform over large area. The ability of the dielectric surface to perform the release function in the image transfer step was determined by measuring the image transfer efficiency.

To determine the efficiency, the reflective optical density was measured in the image and background areas of the imaged "self-releasing" construction before and after transferring the liquid toner image to a receptor surface, and the transfer efficiency was calculated using the equation shown earlier in this text. The receptor material in these image transfers was 4 mil Scotchcal coated with a pigmented vinylacrylic and transfer technique was employed using a vacuum drawdown frame. The image donor and receptor surfaces were forced together with a pressure of one atmosphere for five minutes at the temperature of 112 degrees C.

The following table shows the test results for various "self-releasing" dielectric constructions in which the polymeric portion of the coating comprises a blend between a dielectric resin and an image releasing material. The Table includes optical density values for the developed image and the measured efficiency with which it is released to the receptor surface.

IMAGE TRANSFER EFFICIENCY (%)

| SAMPLE | OD | HVA |
|---|---|---|
| 50/50 50% SU/NAS 81 | 1.39 | 97.3 |
| 50/50 50% SU/NAS 81 | 1.41 | 97.2 |
| 75/25 50% SU/BUTVAR TM 76 | 1.38 | — |
| 50/50 50% SU/BUTVAR TM 76 | 1.56 | 62.4 |
| 50/50 50% SU/BUTVAR TM 76 | 1.55 | 63.5 |
| 50/50 50% SU/p.STYRENE | 1.39 | 97.3 |
| 50/50 25% SU/PMMA | 1.50 | 94.4 |

50% SU - silicone-urea copolymer containing 50% silicone
50/50 - silicone-urea copolymer/dielectric resin ratio The data show that dielectric resins such as NAS 81, polystyrene and polymethylmethacrylate (PMMA), when mixed with a silicone-urea copolymer containing 50% silicone, can be used to produce image releasing dielectric coatings suitable for electrographic imaging. Image release is less efficient from coatings containing a blend of silicone-urea copolymer with Butvar TM 76 (polyvinyl butyral) resin.

EXAMPLES

Dielectric paper, Type 2089 produced by James River Graphics Corporation, was overcoated with a 5% solution of silicone-urea copolymer in isopropanol (10% silicone content) using a combination of 5 and 0 Meyer bars. The estimated dry thickness of the silicone/urea layer was about 0.11 micrometer. The release-coated dielectric paper was used in the Synergy electrostatic printer for imaging experiments.

In a series of tests various combinations of liquid toners were evaluated for their ability to produce high quality images in the Synergy Colorwriter TM 400 electrostatic printer by printing test patches of solid and 40% halftone patches of all single and all overlaying color combinations using black, cyan, magenta and yellow liquid toners. The toners were evaluated for image susceptibility to abrasion damage on the release-coated imaging surface and for the ability to form uniform toner deposits over a previously formed image of a different color.

Example 1

The release coated dielectric paper and liquid toners B-1 (black), C-1 (cyan), M-2 (magenta) and Y-1 (yellow) were loaded in the Synergy printer and the test image, described above, was printed at a paper travel speed of 0.125 in/sec (3.18 mm/sec). The image on the release surface appears to be of high quality, i.e. there are no abrasion marks on any of the test patches, and the deposition of a second color over a first color image formed in a preceding imaging station is uniform and of sufficient thickness to produce good secondary colors green, blue and red (yellow over cyan, magenta over cyan and yellow over magenta).

Example 2

The experiment described in Example 1 was repeated using different black and magenta and a similar yellow toner in the combination, i.e. B-2 (black), C-1 (cyan), M-1 (magenta) and Y-1 (yellow). The print quality obtained with this combination of toners is dramatically different and unacceptable as indicated by the description of individual test patches shown below:

black (B) some image abrasion
cyan (C) no abrasion
magenta (M) no abrasion yellow (Y) no abrasion
green (C+Y) slight abrasion damage
blue (C+M) slight abrasion damage
red (M+Y) M abraded where overprinted by Y
(C+M+Y) bad abrasion damage
(B+M+Y) abrasion worse than for M+Y
(B+C+M) bad abrasion damage
(B+C+Y) bad abrasion damage

Example 3

In the toner combination which was used in Example 2 the M-1 magenta toner was replaced with a different formulation, M-2. With this set of toners abrasion damage was eliminated in test patches containing the new magenta (except where the magenta toner was deposited over a black toner layer):

B some abrasion damage
C no abrasion
M no abrasion
Y no abrasion
(C+Y) some abrasion damage
(C+M) no abrasion
(M+Y) no abrasion
(B+M+Y) abrasion damage
(B+C+M) abrasion damage

REFERENCE EXAMPLES

The following Examples 1–6 of block copolymers show how the polydimethylsiloxane release coating polymers may be prepared for use in the present invention. An enabling description of these polymers is also provided.

The general synthetic scheme of the release coating is:

| -[-(silicone)$_a$-(hard segment)$_b$-(soft segment)$_c$-]$_n$- | | | |
|---|---|---|---|
| | 5% | 75% | 20% |
| or | 10% | 75% | 15% |
| | Silicone | DIPIP/IPDI | Jeffamine |

where silicone is PDMS, DIPIP is dipiperidyl propane, IPDI is isophorone diisocyanate, and Jeffamine is a polypropyleneoxide with diamine terminal groups.

The amount of hard segment is very important in this use; results have shown there must be no less than 75% of hard segment when there is a non-silicone soft segment. The $T_g$ results appear to be the most direct indication for the 75% minimum.

It has been demonstrated that a good image is achieved with less than 75% Hard Segment, but only when no soft segment is present and the silicone (PDMS) proportion is higher, such as 30% to 50%.

This is well explained by the samples listed in the chart, wherein all the samples provided a good image except the sample with "0" silicone (PDMS).

| % PDMS 5,000 Mn | % Jeffamine Du-700 (800 Mn) | % Hard Segment DIPIP/IPDI |
|---|---|---|
| 0 | 25 | 75 |
| 5 | 20 | 75 |
| 15 | 10 | 75 |
| 20 | 5 | 75 |
| 50 | 0 | 50 |

The solvent was isopropanol.
Silicone=(PDMS) polydimethylsiloxane
Hard Segment=(DIPIP) Dipiperidyl propane/IPDI (Isophorone diisocyanate)
Soft Segment=(Jeffamine) DU-700

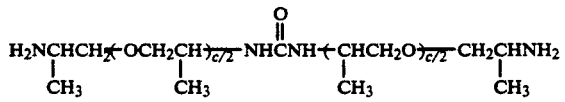

where c=11.2

Other segments with PDMS will function as release material, but have proven to produce fuzzy images, such as:

Hard Segments = (MPMD) methyl pentane methylene diamine/IPDI or (BISAPIP) bisaminopropylpiperizine/IPDI
Soft Segment = (PPO) polypropylene oxide The preferred organopolysiloxane-polyurea block polymers comprise a repeating unit of the Formula I:

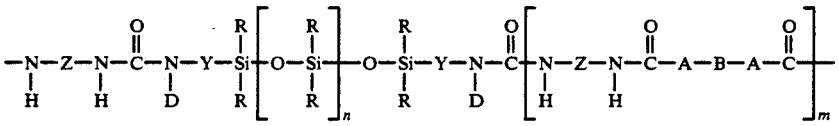

where:

Z is a divalent radical selected from the group consisting of phenylene, alkylene, aralkylene and cycloalkylene;

Y is an alkylene radical of 1 to 10 carbon atoms;

R is at least 50% methyl with the balance of the 100% of all R radicals being selected from the group consisting of a monovalent alkyl radical having from 2 to 12 carbon atoms, a vinyl radical, a phenyl radical, and a substituted phenyl radical;

D is selected from the group consisting of hydrogen, and an alkyl radical of 1 to 10 carbon atoms;

B is selected from the group consisting of alkylene, aralkylene, cycloalkylene, azaalkylene, cycloazaalkylene, phenylene, polyalkylene oxides, polyethylene adipate, polycaprolactone, polybutadiene, and mixtures thereof, and a radical completing a ring structure including A to form a heterocycle;

A is selected from the group consisting of

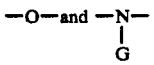

where G is selected from the group consisting of hydrogen, an alkyl radical of 1 to 10 carbon atoms, phenyl, and a radical which completes a ring structure including B to form a heterocycle;

n is a number which is 10 (preferably 70) or larger, and m is a number which can be zero to about 25.

In the preferred block copolymer z is selected from the group consisting of hexamethylene, methylene bis-(phenylene), isophorone, tetramethylene, cyclohexylene, and methylene dicyclohexylene and R is methyl.

The organopolysiloxane-polyurea block polymer useful in the present invention must be organic non-aqueous solvent-compatible. As used herein, "compatible" means that the copolymer is soluble in organic solvent (only in non-aqueous solvents). The water-compatible polymers contain ionic groups in the polymer chain and are not satisfactory when coated on dielectric material as a functional toner release material. Upon drying the water is removed, leaving the polar non-Silicone segment (Quaternary amine) on the surface, and the Silicone is left almost totally submerged under the polar non-silicone layer; thus not sufficient Silicone on the contact surface with the toner(s) and thus no toner(s) release capabilities upon attempted transfer of image.

The block polymers useful in the invention may be prepared by polymerizing the appropriate components under reactive conditions in an inert atmosphere.

The components comprise:

(1) a diamine having a number average molecular weight (Mn) of at least 500 and a molecular structure represented by Formula II as follows:

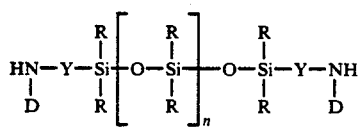

where R, Y, D and n are as defined in Formula I;

(2) at least one diisocyanate having a molecular structure represented by Formula III as follows:

OCN—Z—NCO where Z is as defined in Formula I (3) up to 95% weight percent diamine or dihydroxy chain extender having a molecular structure represented by Formula IV as follows:

H—A—B—A—H where A AND B are defined above.

The combined molar ratio of silicone diamine, diamine and/or dihydroxy chain extender to diisocyanate in the reaction is that suitable for the formation of a block polymer with desired properties. Preferably the ratio is maintained in the range of about 1:0.95 to 1:1.05.

Specifically solvent-compatible block polymers useful in the invention may be prepared by mixing the organopolysiloxane diamine, diamine and/or dihydroxy chain extender, if used, and diisocyanate under reactive conditions, to produce the block polymer with hard and soft segments respectively derived from the diisocyanate and organopolysiloxane diamine. The reaction is typically carried out in a reaction solvent.

The donor element of the invention may be prepared by a variety of techniques. Preparation of the donor element may be easily accomplished but the surface to be treated must first be cleaned of all dirt and grease. Approved cleaning techniques may be used. The surface is then contacted with the solution of organopolysiloxane-polyurea polymer by use of one of a variety of techniques such as brushing, bar coat, spraying, roll coating, curtain coating, knife coating, etc.; and then processed at a time for a temperature so as to cause the polymer to form a dried layer on the surface. For image release coatings a suitable level of dried coating thickness is in the range 0.05 to 2.0 micrometers, with a preferred thickness range of 0.08 to 0.3 micrometers, and with best success at about 0.12 to 0.18 micrometers.

The non-aqueous polymer solutions, diluted in a solvent, such as isopropanol, to a proper solids concentration and then is coated onto the dielectric material. Coating thickness, once dried, can be properly measured by a chemical indicator method if the proper indicator is included within the non-aqueous release material prior to application to the dielectric material.

Thickness measurement methods such as the cut weight methods are ineffective due to the ultra thin coatings.

A colorless pH indicator, preferably thymolphthalein, is added (not more than 5% of the solid level of the silicone-urea polymer) to the non-aqueous silicone-urea coating material. This colorless indicator is changed to a blue color by the development of an alkaline solution prior to the spectrophotometer absorbance readings and calculations.

A requirement of the release coating is that it must be a very thin coating in order that high density image may be developed between the toner(s) and the dielectric material. The function of the indicator is to monitor the submicron range coating weight of the silicone-urea polymer layer. The coating weight of the polymer, which is proportional to the amount of indicator, is calculated from a color developed alkaline solution, by the absorbance measurements. The indicator within the blocked polymer coating must not only be colorless but must remain in a stable colorless state at neutral pH conditions when applied on the dielectric material. Further more, this colorless indicator material must not interfere with image printing, transfer, or aging of transferred image.

Other indicators may perform as well as the preferred indicator noted in the previous paragraph, and these would be such as m-nitrophenol, o-cresolphthalein, phenolphthalein, ethyl bis (2,4-dinitrophenyl) acetate. Other classes of indicators, though not evaluated, which should function as well, are those which respond by oxidation-reduction.

The preferred method of preparation which provides the best results uses 5–10% silicone, with 15–20% soft segment and 75% hard segment and contains 12.6% solids.

This non-aqueous release polymer is diluted to a 3–5% solution and coated on James River Graphics dielectric paper #2089, using a #0 or #1 Meyer bar which thus provides a release coating thickness of 0.12 microns for Meyer Bar #0 and 0.18 microns for Meyer Bar #1. The acceptable coating range thickness is 0.08 to 0.3 microns, with a preferred coating range of 0.1 to 0.2 microns.

Block Polymer Example 1.

To a solution of 0.38 g of 5000 number average molecular weight ($M_n$) polydimethylsiloxane (PDMS) diamine, 1.50 g of 800 number average molecular weight ($M_n$) Jeffamine (Du-700) and 2.52 g of Dipiperidyl propane (DIPIP) in 242.50 gm of isopropyl alcohol (IPA) at 25° C. was added 3.10 g of isophorone diisocyanate (IPDI) slowly over a 5 minute period. The viscosity rose rapidly toward the end of the addition and the viscous yet clear reaction was stirred for an additional 15 min. This provided a 3 percent by weight solution of the block polymer in IPA. The block polymer had 5 percent by weight PDMS soft segment and 75 percent by weight DIPIP/IPDI hard segments and 20 percent by weight Jeffamine soft segment.

Block Polymer Example 2.

To a solution of 1.13 g of 5000 number average molecular weight ($M_n$) polydimethylsiloxane (PDMS) diamine, 1.50 g of 800 number average molecular weight ($M_n$) Jeffamine (Du-700) and 2.52 g of Dipiperidyl propane (DIPIP) in 242.5 g of isopropyl alcohol (IPA) at 25° C. was added 3.02 of isophorone diisocyanate (IPDI) slowly over a 5 minute period. The viscosity rose rapidly toward the end of the addition and the viscous yet clear reaction was stirred for an additional 15 min. This provided a 3 percent by weight solution of the block polymer in IPA. The blockpolymer had 15 percent by weight PDMS soft segment and 75 percent by weight DIPIP/IPDI hard segments and 10 percent by weight Jeffamine soft segment.

Block Polymer Example 3.

To a solution of 1.50 g of 5000 number average molecular weight ($M_n$) polydimethylsiloxane (PDMS) diamine, 0.38 g of 800 number average molecular weight ($M_n$) Jeffamine (Du-700) and 2.65 g of Dipiperidyl propane (DIPIP) in 242.5 g of isopropyl alcohol (IPA) at 25° C. was added 2.97 g of isophorone diisocyanate (IPDI) slowly over a 5 minute period. The viscosity rose rapidly toward the end of the addition and the viscous yet clear reaction was stirred for an additional 15 min. This provided a 3 percent by weight solution of the block polymer in IPA. The block polymer had 20 percent by weight PDMS soft segment and 75 percent by weight DIPIP/IPDI hard segments and 5 percent by weight Jeffamine soft segment.

Block Polymer Example 4.

To a solution of 3.75 gm of 5000 number average molecular weight ($M_n$) polydimethylsiloxane (PDMS) diamine, 0 g of 800 number average molecular weight ($M_n$) Jeffamine (Du-700) and 1.74 g of Dipiperidyl propane (DIPIP) in 242.5 g of isopropyl alcohol (IPA) at 25° C. was added 2.01 g of isophorone diisocyanate (IPDI) slowly over a 5 minute period. The viscosity rose rapidly toward the end of the addition and the viscous yet clear reaction was stirred for an additional 15 min. This provided a 3 percent by weight solution of the block polymer in IPA. The block polymer had 50 percent by weight PDMS soft segment and 50 percent by weight DIPIP/IPDI hard segments and 0 percent by weight Jeffamine soft segment. Examples 1–4 were all very functional with clear images on transfer. They were all run under nitrogen atmosphere.

Block Polymer Example 5.

To a solution of 65 g of 5000 number average molecular weight ($M_n$) polydimethylsiloxane (PDMS) diamine and 15.2 g of bisaminopropylpiperazine (bisAPIP) in 530 ml of isopropyl alcohol (IPA) at 25° C., was added 19.8 g of isophorone diisocyanate (IPDI) slowly over a 5 minute period. The exothermic reaction was controlled by means of an ice water bath to maintain the temperature at 15° C. to 25° C. during the addition. The viscosity rose rapidly toward the end of the addition and the viscous yet clear reaction was stirred for an additional 1 hour. This provided a 20 percent by weight solution of the block polymer in IPA. The block polymer had 65 percent by weight PDMS soft segments and 35 percent by weight bisAPIP/IPDI hard segments.

Block Polymer Example 6.

A 250 ml. three neck flask was charged with 5 g of 5000 ($M_n$) PDMS diamine, 1.29 g of bisAPIP, 0.56 g of methylpentamethylene diamine (MPMD) and 40 g of isopropyl alcohol. The resulting solution was cooled to 20° C. with an ice bath while 2.76 g of IPDI was added. This provided the silicone polyurea as a very viscous yet clear solution in IPA. The block polymer had 52 weight percent PDMS soft segments and 48 weight percent hard segments (35 weight percent bisAPIP-/IPDI and 13 weight percent MPMD).

The following Examples 7 and 8 relate to polymeric materials for use in self releasing dielectric layers in the practice of one embodiment of the present invention.

Dielectric Layer Example 7.

Preparation of copolymers and terpolymers of vinyl monomers with siloxane macromonomers is described in U.S. Pat. No. 4,728,571. Using that preparation and selecting methyl methacrylate (MMA) or a mixture of MMA and styrene as the vinyl monomer and further selecting polydimethylsiloxane as the siloxane macromonomer provides a route to the polymers used in this invention for self-releasing dielectric layers.

Dielectric Layer Example 8.

The dielectric layers were made by coating solutions containing the copolymer or terpolymer onto a paper substrate. Coating solutions were made from the polymer solutions according to the following formula in which percentages are weight percent:

| | |
|---|---|
| Polymer Solution — 30% solids in 2:1 ethyl acetate/toluene | 50% |
| Clay, Translink 37 | 3.75% |
| Calcium Carbonate | 2.50% |
| Titanium Dioxide | 1.25% |
| Toluene | 50% |

These solutions were ballmilled for 4 hours and coated on "conductivized" paper base from James River Graphics, using a #14 Meyer rod giving a wet thickness of 30.5 micrometers. After drying, the coatings were conditioned at 50% RH and 70° F. (21° C.) for 12 hours before use in imaging.

Dielectric Layer Example 9.

Using silicone-urea block polymers containing 10% and 25% by weight of PDMS (described above) in place of the ter- and co-polymers in Dielectric Layer Example 8 above, coatings were made and conditioned as in that example. Good toner image deposition was obtained and transfer efficiency was above 98% for each coating.

The following dielectric layer examples 10 are directed to the use of mixtures of dielectric materials and release materials.

Dielectric Layer Example 10.

Mixtures of a dielectric polymer solution from group A with a silicone-urea solution from group B were made in the ratios indicated in Table 10 below. To these mixtures solids were added such as follows in which percentages are by weight.

| | |
|---|---|
| 93% | mixed polymer solution. |
| 3.5% | clay, Translink 37. |
| 2.3% | calcium carbonate. |

-continued

| | |
|---|---|
| 1.2% | titanium dioxide. |

These solutions were ballmilled for 16 hours and coated on "conductivized" paper from James River Graphics using a #14 Meyer rod. After drying the coatings were conditioned at 50% RH and 19° C. for 4 hours before testing.

Group A materials.

NAS 81.

A styrene/methylmethacrylate copolymer purchased from Richardson Polymer Corp. and made into a 20% solids solution in toluene.

BUTVAR TM B-76.

Polyvinyl butyral manufactured by Monsanto Co. and made into a 10% solids solution in toluene.

POLYSTYRENE.

Made into a 20% solids solution in toluene.

POLYMETHYLMETHACRYLATE.

Made into a 30% solids solution in ethyl acetate/toluene.

Group B materials.

SILICONE-UREA containing 10% PDMS.

Obtained as 15% solids solution in IPA.

SILICONE-UREA containing 25% PDMS.

Obtained as 15% solids solution in IPA/toluene.

SILICONE-UREA containing 50% PDMS.

Obtained as 15% solids solution in IPA/toluene.

TABLE 10

IMAGING RESULTS ON MIXTURES.

| SAMPLE | VOLT | OD | % trnfr |
|---|---|---|---|
| 50:50 50% SU/NAS 81 | 76.7 | 1.39 | 97.3 |
| 75:25 50% SU/BUTVAR 76 | 86.3 | 1.36 | >65 |
| 50:50 50% SU/BUTVAR 76 | 60.3 | 1.56 | 62.4 |
| 50:50 50% SU/POLYSTYRENE | 92.0 | 1.39 | 97.3 |
| 50:50 25% SU/PMMA | 48.0 | 1.50 | 94.4 |

What we claim is:

1. An electrographic process for producing multicolored toned images in an electrostatic printer, comprising the steps of a) providing a flexible imaging sheet having at least one surface exhibiting dielectric properties and toner release properties characterized by a surface energy between 14 ergs/cm$^2$ and 20 ergs/cm$^2$, not more than 5% of the total of said surface energy resulting from polar components in said surface, b) moving said imaging sheet at a substantially steady rate through the printer, c) producing on said surface of said imaging sheet a first electrostatic latent image corresponding to a first color by imagewise deposition of charges, d) developing said first latent image by means of a rotating applicator bar with a first liquid toner corresponding to said first color to produce a first toned image, said first toned image then exhibiting a scratch test strength of not less than 40 g and a surface energy of not more than 50 ergs/cm$^2$, e) drying said first toned image, f) repeating steps c), d), and e) in sequence using toners corresponding to at least one more color to complete said multicolored toned image, so that where a later developed toner overlays an earlier developed toner the interface created between said earlier toner and said later toner has a work of adhesion value greater than the largest of work of adhesion values of interfaces created between said toners and said imaging sheet surface, and g) bringing said multicolor toner image deposited on said surface of said imaging sheet in contact with a receptor sheet surface under pressure and at an elevated temperature, so that said multitoned image is transferred to said receptor sheet surface without distortion, said receptor sheet surface having a surface energy greater than the surface energy of said imaging sheet surface, and said receptor sheet surface having a $T_g$ value between 10° C. and a value 5° C. below said elevated temperature.

2. An electrographic process as recited in claim 1 wherein said flexible imaging sheet comprises a conducting substrate coated on one of its two major surfaces with a dielectric layer and a separate top layer having said release properties.

3. An electrographic process as recited in claim 2 wherein said top layer comprises a release material selected from the group consisting of silicone-urea block polymers containing from 1% to 65% by weight of polydimethylsiloxane, urethanesilicone copolymers, epoxy-silicone copolymers, and acrylic-silicone copolymers.

4. The electrographic process of claim 3 wherein said multicolored toned image is produced in one pass through said electrostatic printer.

5. The electrographic process of claim 2 wherein said multicolored toned image is produced in one pass through said electrostatic printer.

6. An electrographic process as recited in claim 1 wherein said flexible imaging sheet comprises a conducting substrate coated on one of its two major surfaces with a dielectric layer having said release properties.

7. An electrographic process as recited in claim 6 wherein said dielectric layer comprises materials selected from the group consisting of terpolymers of polydimethylsiloxane, methylmethacrylate, and polystyrene, and copolymers of polydimethylsiloxane and methylmethacrylate, wherein the polydimethylsiloxane constitutes between 10% and 30% of total polymer weight.

8. The electrographic process of claim 7 wherein said multicolored toned image is produced in one pass through said electrostatic printer.

9. An electrographic process as recited in claim 6 wherein said dielectric layer comprises a release material selected from the group consisting of silicone-urea block polymers containing from 1% to 65% by weight of polydimethylsiloxane, urethane-silicone copolymers, epoxy-silicone copolymers, and acrylic-silicone copolymers.

10. An electrographic process as recited in claim 1 wherein said toners comprise a cyan toner, a magenta toner, a yellow toner, and a black toner.

11. An electrographic process as recited in claim 1 wherein said receptor sheet comprises a substrate carrying a thermoplastic layer comprising a polymer selected from the group consisting of a thermoplastic polymers with a complex dynamic viscosity value of less than about $2.5\times10^5$ poise at a temperature equal to said elevated temperature.

12. An electrographic process as recited in claim 11 wherein the complex dynamic viscosity value is less than about $2.0\times10^5$ poise.

13. An electrographic process as recited in claim 11 wherein said thermoplastic layer comprises polymers chosen from the group consisting of methylacrylates, butylmethacrylates, methylmethacrylate copolymers with other acrylates, ethylmethacrylates, isobutylmethacrylates, vinylacetate/vinylchloride copolymers of low molecular weight, polyurethane, and aliphatic polyesters.

14. The electrographic process of claim 13 wherein said multicolored toned image is produced in one pass through said electrostatic printer.

15. An electrographic process as recited in claim 11 wherein said substrate comprises a polymer selected from the group consisting of polyvinylchloride, acrylics, polyurethanes, polyethylene/acrylic acid copolymers, and polyvinyl butyrals.

16. The electrographic process of claim 15 wherein said multicolored toned image is produced in one pass through said electrostatic printer.

17. An electrographic process as recited in claim 11 wherein said elevated temperature is between 50° C. and 150° C.

18. The electrographic process of claim 11 wherein said multicolored toned image is produced in one pass through said electrostatic printer.

19. The electrographic process of claim 1 wherein said multicolored toned image is produced in one pass through said electrostatic printer.

20. An electrographic process for producing multicolored toned images in an electrostatic printer, comprising the steps of a) providing a flexible imaging sheet having at least one surface exhibiting dielectric properties and toner release properties characterized by a surface energy between 14 ergs/cm$^2$ and 20 ergs/cm$^2$, said surface comprising a dispersion component and a polar component of said surface with not more than 5% of the total of said surface energy being contributed by said polar component, b) moving said imaging sheet at a substantially steady rate through the printer, c) producing on said surface of said imaging sheet a first electrostatic latent image corresponding to a first color by imagewise deposition of charges, d) developing said first latent image by means of a rotating applicator bar with a first liquid toner corresponding to said first color to produce a first toned image, said first toned image then exhibiting a scratch test strength of not less than 40 g and a surface energy of not more than 50 ergs/cm$^2$, e) drying said first toned image, f) repeating steps c), d), and e) in sequence using toners corresponding to at least one different color to complete said multicolored toned image, so that where a later developed toner overlays an earlier developed toner the interface created between said earlier toner and said later toner has a work of adhesion value greater than the largest of work of adhesion values of interfaces created between said toners and said imaging sheet surface, and g) bringing said multicolor toned image which has been deposited on said surface of said imaging sheet in contact with a receptor sheet surface under pressure and at an elevated temperature, so that said multitoned image is transferred to said receptor sheet surface without distortion, said receptor sheet surface having a surface energy greater than the surface energy of said imaging sheet surface, and said receptor sheet surface having a $T_g$ value between 10° C. and a value 5° C. below said elevated temperature.

21. An electrographic process for producing multicolored toned images in an electrostatic printer, comprising the steps of a) providing a flexible imaging sheet having at least one surface exhibiting dielectric properties and toner release properties characterized by a surface energy between 14 ergs/cm$^2$ and 20 ergs/cm$^2$, said surface comprising a dispersion component a polar component, with not more than 5% of the total of said surface energy being contributed to by said polar component, b) moving said imaging sheet at a substantially steady rate through the printer, c) producing on said surface of said imaging sheet with a stylus or electrostatic imaging bar a first electrostatic latent image corresponding to a first color by imagewise deposition of charges, d) developing said first latent image by means of a rotating applicator bar with a first liquid toner corresponding to said first color to produce a first toned image, said first toned image then exhibiting a scratch test strength of not less than 40 g and a surface energy of not more than 50 ergs/cm$^2$, e) drying said first toned image, f) repeating steps c), d), and e) in sequence using toners corresponding to at least one different color to complete said multicolored toned image, so that where a later developed toner overlays an earlier developed toner the interface created between said earlier toner and said later toner has a work of adhesion value greater than the largest of work of adhesion values of any interfaces created between said toners and said imaging sheet surface, and g) bringing said multicolor toned image deposited on said surface of said imaging sheet in contact with a receptor sheet surface under pressure and at an elevated temperature, so that said multitoned image is transferred to said receptor sheet surface without distortion, said receptor sheet surface having a surface energy greater than the surface energy of said imaging sheet surface, and said receptor sheet surface having a $T_g$ value between 10° C. and a value 5° C. below said elevated temperature.

22. An electrographic process as recited in claim 21 wherein at least one surface of said flexible imaging sheet comprises a release material selected from the group consisting of silicone-urea block polymers containing from 1% to 65% by weight of polydimethylsiloxane, urethane-silicone copolymers, epoxy-silicone copolymers, and acrylic-silicone copolymers.

23. An electrographic process as recited in claim 22 wherein said receptor sheet comprises a substrate carrying a thermoplastic layer comprising a polymer selected from the group consisting of a thermoplastic polymer with a complex dynamic viscosity value of less than about $2.5\times10^5$ poise at a temperature equal to said elevated temperature.

24. An electrographic process as recited in claim 23 wherein said thermoplastic layer comprises polymers chosen from the group consisting of methylacrylates, butylmethacrylates, methylmethacrylate copolymers with other acrylates, ethylmethacrylates, isobutylmethacrylates, vinylacetate/vinylchloride copolymers of low molecular weight, polyurethane, and aliphatic polyesters.

25. An electrographic process as recited in claim 24 wherein said elevated temperature is between 50° C. and 150° C.

26. An electrographic process as recited in claim 22 wherein said elevated temperature is between 50° C. and 150° C.

27. An electrographic process as recited in claim 21 wherein said receptor sheet comprises a substrate carrying a thermoplastic layer comprising a polymer selected from the group consisting of a thermoplastic polymer with a complex dynamic viscosity value of less than about $2.5\times10^5$ poise at a temperature equal to said elevated temperature.

28. An electrographic process as recited in claim 21 wherein said thermoplastic layer comprises polymers chosen from the group consisting of methylacrylates, butylmethacrylates, methylmethacrylate copolymers with other acrylates, ethylmethacrylates, isobutylmethacrylates, vinylacetate/vinylchloride copolymers of low molecular weight, polyurethane, and aliphatic polyesters.

29. An electrographic process as recited in claim 21 wherein said elevated temperature is between 50° C. and 150° C.

30. An electrographic process as recited in claim 21 wherein said dielectric layer comprises a mixture of components A and B, said component A consisting of one or more members selected from the group consisting of dielectric polymers and resins, and said component B consisting of one or more members selected from the group consisting of release materials, the components A and B being present in a weight ratio in the range 1:10 to 10:1.

31. An electrographic process for producing multicolored tones images in an electrostatic printer, comprising the steps of a) providing a flexible imaging sheet having at least one surface exhibiting dielectric properties and toner release properties characterized by a surface energy between 14 ergs/cm$^2$ and 20 ergs/cm$^2$, said surface comprising a dispersion component and a polar component of said surface energy, not more than 5% of the total of said surface energy resulting from polar components of said surface energy in said surface, b) moving said imaging sheet at a substantially steady rate through the printer, c) producing on said surface of said imaging sheet a first electrostatic latent image corresponding to a first color by imagewise deposition of charges, d) developing said first latent image by means of a rotating applicator bar with a first liquid toner corresponding to said first color to produce a first toned image, said first toned image then exhibiting a scratch test strength of not less than 40 g and a surface energy of not more than 50 ergs/cm$^2$, e) drying said first toned image, f) repeating steps c), d), and e) in sequence using toners corresponding to at least one more color to complete said multicolored toned image, so that where a later developed toner overlays an earlier developed toner the interface created between said earlier toner and said later toner has a work of adhesion value greater than the largest of work of adhesion values of interfaces created between said toners and said imaging sheet surface, and g) bringing said multicolor toned image deposited on said surface of said imaging sheet in contact with a receptor sheet surface under pressure and at an elevated temperature of 90° C. to 130° C., so that said multitoned image is transferred to said receptor sheet surface without distortion, said receptor sheet surface having a surface energy greater than the surface energy of said imaging sheet surface and said receptor sheet surface having a $T_g$ value between 10° C. and a value 5° C. below said elevated temperature, wherein said flexible imaging sheet comprises a conducting substrate coated on one of its two major surfaces with a dielectric layer having said release properties.

32. An electrographic process for producing multicolored toned images in an electrostatic printer, comprising the steps of a) providing a flexible imaging sheet having at least one surface exhibiting dielectric properties and toner release properties characterized by a surface energy between 14 ergs/cm$^2$ and 20 ergs/cm$^2$, said surface comprising a dispersion component and a polar component of said surface energy, not more than 5% of the total of said surface energy resulting from any polar component of said surface energy in said surface, b) moving said imaging sheet at a substantially steady rate through the printer, c) producing on said surface of said imaging sheet a first electrostatic latent image corresponding to a first color by imagewise deposition of charges, d) developing said first latent image by means of a rotating applicator bar with a first liquid toner corresponding to said first color to produce a first toned image, said first toned image then exhibiting a scratch test strength of not less than 40 g and a surface energy of not more than 50 ergs/cm$^2$, e) drying said first toned image, f) repeating steps c), d), and e) in sequence using toners corresponding to at least one more color to complete said multicolored toned image, so that where a later developed toner overlays an earlier developed toner the interface created between said earlier toner and said later toner has a work of adhesion value greater than the largest of work of adhesion values of interface created between said toners and said imaging sheet surface, and g) bringing said multicolor toned image deposited on said surface of said imaging sheet in contact with a receptor sheet surface under pressure and at an elevated temperature, so that said multitoned image is transferred to said receptor sheet surface without distortion, said receptor sheet surface having a surface energy greater than the surface energy of said imaging sheet surface, and said receptor sheet surface having a $T_g$ value between 10° C. and a value 5° C. below said elevated temperature, wherein said flexible imaging sheet comprises a conducting substrate coated on one of its two major surfaces with a dielectric layer having said release properties and wherein said dielectric layer comprises a mixture of components A and B, said component A consisting of one or more members selected from the group consisting of dielectric polymers and resins, and said component B consisting of one or more members selected from the group consisting of release materials, the components A and B being present in a weight ratio in the range 1:10 to 10:1.

33. An electrographic process as recited in claim 32, wherein component A is chosen from one or more of the members of the group consisting of polystyrene, polymethacrylate, polymethylmethacrylate, polyacrylate, polyvinyl butyral resins, and styrene/methylmethacrylate copolymers.

34. An electrographic process as recited in claim 32, wherein component B is chosen from one or more of the members of the group consisting of polydimethylsiloxane, silicone-urea block polymers containing from 1% to 65% by weight of polydimethylsiloxane, urethane-silicone copolymers, epoxy-silicone copolymers, and acrylic-silicone copolymers, fluorinated polymers, and copolymers containing fluorinated moieties.

35. An electrographic process for producing multicolored toned images in an electrostatic printer, comprising the steps of a) providing a flexible imaging sheet having at least one surface exhibiting dielectric properties and toner release properties characterized by a surface energy between 14 ergs/cm$^2$ and 20 ergs/cm$^2$, said surface comprising a dispersion component and a polar component of said surface energy, with not more than 5% of the total of said surface energy being contributed to by said polar component, b) moving said imaging sheet at a substantially steady rate through the printer, c) producing on said surface of said imaging sheet with a stylus or electrostatic imaging bar a first electrostatic latent image corresponding to a first color by imagewise deposition of charges, d) developing said first latent image by means of a rotating applicator bar with a first liquid toner corresponding to said first color to produce a first toned image, said first toned image then exhibiting a scratch test strength of not less than 40 g and a surface energy of not more than 50 ergs/cm$^2$, e) drying said first toned image, f) repeating steps c), d), and e) in sequence using toners corresponding to at least one different color to complete said multicolored toned image, so that where a later developed toner overlays an earlier developed toner the interface created between said earlier toner and said later toner has a work of adhesion value greater than the largest of work of adhesion values of any interfaces created between said toners and said imaging sheet surface, and g) bringing said multicolor toned image deposited on said surface of said imaging sheet in contact with a receptor sheet surface under pressure and at an elevated temperature, so that said multitoned image is transferred to said receptor sheet surface without distortion, said receptor sheet surface having a surface energy greater than the surface energy of said imaging sheet surface, and said receiptor sheet surface having a $T_g$ value between 10° C. and a value 5° C. below said elevated temperature, wherein at least one surface of said flexible imaging sheet comprises a release material selected from the group consisting of silicone-urea block polymers containing from 1% to 65% by weight of polydimethylsiloxane, urethane-silicone copolymers, epoxy-silicone copolymers, and acrylic-silicone copolymers, wherein said receptor sheet comprises a substrate carrying a thermoplastic layer comprising a polymer selected from the group consisting of a thermoplastic polymer with a complex dynamic viscosity value of less than about $2.5\times10^5$ poise at a temperature equal to said elevated temperature, wherein said thermoplastic layer comprises polymers chosen from the group consisting of methylacrylates, butylmethacrylates, methylmethacrylate copolymers with other acrylates, ethylmethacrylates, isobutylmethacrylates, vinylacetate/vinylchloride copolymers of low molecular weight, polyurethane, and aliphatic polyesters, wherein said elevated temperature is between 50° C. and 150° C., and wherein said multicolored toned image is produced in one pass through said electrostatic printer.

36. An electrographic process for producing multicolored toned images in an electrostatic printer, comprising the steps of a) providing a flexible imaging sheet having at least one surface exhibiting dielectric properties and toner release properties characterized by a surface energy between 14 ergs/cm$^2$ and 20 ergs/cm$^2$, said surface comprising a dispersion component and a polar component of said surface energy, with not more than 5% of the total of said surface energy being contributed to by said polar component, b) moving said imaging sheet at a substantially steady rate through the printer, c) producing on said surface of said imaging sheet with a stylus or electrostatic imaging bar a first electrostatic latent image corresponding to a first color by imagewise deposition of charges, d) developing said first latent image by means of a rotating applicator bar with a first liquid toner corresponding to said first color to produce a first toned image, said first toned image then exhibiting a scratch test strength of not less than 40 g and a surface energy of not more than 50 ergs/cm$^2$, e) drying said first toned image, f) repeating steps c), d), and e) in sequence using toners corresponding to at least one different color to complete said multicolored toned image, so that where a later developed toner overlays an earlier developed toner the interface created between said earlier toner and said later toner has a work of adhesion value greater than the largest of work of adhesion values of any interfaces created between said toners and said imaging sheet surface, and g) bringing said multicolor toned image deposited on said surface of said imaging sheet in contact with a receptor sheet surface under pressure and at an elevated temperature, so that said multitoned image is transferred to said receptor sheet surface without distortion, said receptor sheet surface having a surface energy greater than the surface energy of said imaging sheet surface, and said receiptor sheet surface having a $T_g$ value between 10° C. and a value 5° C. below said elevated temperature, wherein said dielectric layer comprises a mixture of components A and B, said component A consisting of one or more members selected from the group consisting of dielectric polymers and resins, and said component B consisting of one or more members selected from the group consisting of release materials, the components A and B being present in a weight ratio in the range 1:10 to 10:1.

* * * * *

UNITED STATES PATENT AND TRADEMARK OFFICE

CERTIFICATE OF CORRECTION

PATENT NO. : 5,262,259

DATED : November 16, 1993

INVENTOR(S) : Chou et al.

It is certified that error appears in the above-indentified patent and that said Letters Patent is hereby corrected as shown below:

Column 6, line 54, delete "develop,ent" and insert --development--.

Column 32, line 3, delete "toner" and insert --toned--.

Column 33, line 36, after "surface" and before "with", insert --energy--.

Column 34, line 10, after "surface" and before "comprising", insert --energy--.

Signed and Sealed this

Tenth Day of January, 1995

Bruce Lehman

*Attest:*

BRUCE LEHMAN

*Attesting Officer*

*Commissioner of Patents and Trademarks*